US008397945B2

(12) United States Patent
Gelardi et al.

(10) Patent No.: US 8,397,945 B2
(45) Date of Patent: Mar. 19, 2013

(54) DISPENSING CONTAINER

(75) Inventors: John A. Gelardi, Midlothian, VA (US); Ryan A. Bailey, Raleigh, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 12 days.

(21) Appl. No.: 12/814,015

(22) Filed: Jun. 11, 2010

(65) Prior Publication Data

US 2011/0204074 A1 Aug. 25, 2011

Related U.S. Application Data

(63) Continuation-in-part of application No. 29/356,296, filed on Feb. 23, 2010, now Pat. No. Des. 631,353, and a continuation-in-part of application No. 29/356,298, filed on Feb. 23, 2010, now Pat. No. Des. 631,747, and a continuation-in-part of application No. 29/356,300, filed on Feb. 23, 2010, now Pat. No. Des. 631,354.

(51) Int. Cl.
*A47K 10/24* (2006.01)
*B65H 1/00* (2006.01)

(52) U.S. Cl. ..... 221/45; 221/172; 221/154; 221/197; 221/46; 221/246; 221/256; 221/268; 221/255; 206/538; 206/539; 206/534; 206/534.2; 206/473; 206/486; 220/849; 220/839

(58) Field of Classification Search ..... 206/538, 206/473, 539, 534, 534.2, 486; 221/172, 221/154, 197, 45, 46, 246, 255, 256, 268; 220/849, 839
See application file for complete search history.

(56) References Cited

U.S. PATENT DOCUMENTS

| | | | | |
|---|---|---|---|---|
| 194,197 | A | 8/1877 | Villaret | |
| 536,923 | A | 4/1895 | Mayled | |
| 2,090,530 | A | 8/1937 | Guffy et al. | |
| D134,249 | S | 11/1942 | Button | |
| 3,696,917 | A | 10/1972 | Levi | |
| 3,782,584 | A | 1/1974 | Swenson et al. | |
| 3,895,737 | A | 7/1975 | Phillips | |
| 4,057,145 | A * | 11/1977 | Wray et al. | 206/538 |
| 4,154,365 | A | 5/1979 | Lorca | |
| 4,284,204 | A | 8/1981 | Cary, Jr. | |
| 4,437,579 | A | 3/1984 | Obland | |
| 4,561,544 | A | 12/1985 | Reeve | |
| 4,572,376 | A | 2/1986 | Wrennall | |
| 4,611,727 | A | 9/1986 | Graff | |
| 4,705,165 | A | 11/1987 | Thieke | |
| D307,555 | S | 5/1990 | Haenni et al. | |

(Continued)

FOREIGN PATENT DOCUMENTS

| | | | |
|---|---|---|---|
| CH | 180218 | A | 10/1935 |
| GB | 686 870 | A | 2/1953 |

(Continued)

*Primary Examiner* — Gene O. Crawford
*Assistant Examiner* — Rakesh Kumar
(74) *Attorney, Agent, or Firm* — Womble Carlyle Sandridge & Rice, LLP

(57) ABSTRACT

A container adapted for dispensing a product is provided. The container includes an outer casing body for receiving a dispensing tray. The dispensing tray has an internal storage compartment for storage of a plurality of units of a product to be dispensed, and includes a cover portion defining at least one dispensing aperture through which a stored unit of product is accessible when the outer casing body is in a dispensing position. A sealing member is engaged with one of the outer casing body and the dispensing tray, and is configured to interact with the other of the outer casing body and the dispensing tray to form a seal about an outer peripheral portion of the dispensing tray when the outer casing body is in a closed and locked position. The container includes a locking mechanism that releasably locks the outer casing body in the closed and locked position.

33 Claims, 23 Drawing Sheets

U.S. PATENT DOCUMENTS

| | | | | |
|---|---|---|---|---|
| 5,108,006 | A | 4/1992 | Tieke et al. | |
| 5,174,471 | A | 12/1992 | Kozlowski et al. | |
| 5,275,291 | A | 1/1994 | Sledge | |
| 5,657,901 | A | 8/1997 | Farside | |
| 5,729,955 | A | 3/1998 | Yamada | |
| D393,591 | S | 4/1998 | Baryshyan | |
| 5,782,359 | A | 7/1998 | McAllister et al. | |
| 5,816,441 | A | 10/1998 | Farside | |
| 5,897,025 | A | 4/1999 | Flewitt et al. | |
| 5,909,822 | A | 6/1999 | George et al. | |
| 5,915,560 | A | 6/1999 | George et al. | |
| 6,131,765 | A | 10/2000 | Barry et al. | |
| 6,155,454 | A | 12/2000 | George et al. | |
| D444,058 | S | 6/2001 | Hampshire et al. | |
| 6,267,265 | B1 | 7/2001 | Issa | |
| 6,460,693 | B1 | 10/2002 | Harrold | |
| 6,527,138 | B2 | 3/2003 | Pawlo et al. | |
| 6,758,338 | B2 | 7/2004 | Lien | |
| D495,545 | S | 9/2004 | Niehues | |
| 6,863,175 | B2 | 3/2005 | Gelardi | |
| 6,913,149 | B2 | 7/2005 | Gelardi et al. | |
| 6,976,576 | B2 * | 12/2005 | Intini | 206/1.5 |
| D531,499 | S | 11/2006 | Zaidman | |
| 7,159,720 | B2 | 1/2007 | Pearson | |
| 7,216,776 | B2 * | 5/2007 | Gelardi | 221/256 |
| 7,288,745 | B2 * | 10/2007 | Colonna | 219/439 |
| 7,353,969 | B2 | 4/2008 | McHutchinson | |
| D572,588 | S | 7/2008 | Osborn | |
| D589,798 | S | 4/2009 | Liipola | |
| 7,565,969 | B2 | 7/2009 | He | |
| 7,588,149 | B2 | 9/2009 | Gelardi | |
| D608,593 | S | 1/2010 | Follansbee et al. | |
| 7,712,630 | B2 | 5/2010 | He | |
| 7,946,450 | B2 * | 5/2011 | Gelardi et al. | 221/154 |
| 2002/0096517 | A1 * | 7/2002 | Gelardi | 220/4.23 |
| 2002/0175195 | A1 | 11/2002 | Cole | |
| 2003/0102323 | A1 * | 6/2003 | Lohn | 220/839 |
| 2004/0217024 | A1 | 11/2004 | Arnarp et al. | |
| 2005/0173272 | A1 | 8/2005 | Lemmons, IV | |
| 2006/0060480 | A1 | 3/2006 | Budd | |
| 2006/0118589 | A1 | 6/2006 | Arnarp et al. | |
| 2006/0124658 | A1 | 6/2006 | Coe et al. | |
| 2006/0243611 | A1 | 11/2006 | Wu | |
| 2007/0068960 | A1 * | 3/2007 | Valentine et al. | 221/25 |
| 2007/0163911 | A1 * | 7/2007 | Gelardi | 206/473 |
| 2007/0277299 | A1 | 12/2007 | Kroon | |
| 2008/0029110 | A1 | 2/2008 | Dube et al. | |
| 2008/0029116 | A1 | 2/2008 | Robinson et al. | |
| 2008/0035643 | A1 * | 2/2008 | Hoffman et al. | 220/345.4 |
| 2009/0223989 | A1 * | 9/2009 | Gelardi | 221/1 |
| 2009/0236357 | A1 * | 9/2009 | Giraud et al. | 220/849 |
| 2009/0266837 | A1 * | 10/2009 | Gelardi et al. | 221/154 |
| 2010/0012534 | A1 * | 1/2010 | Hoffman | 206/265 |
| 2010/0018882 | A1 | 1/2010 | St. Charles | |
| 2010/0018883 | A1 | 1/2010 | Patel | |
| 2010/0059539 | A1 * | 3/2010 | Giraud et al. | 221/36 |
| 2010/0084424 | A1 | 4/2010 | Gelardi | |
| 2010/0133140 | A1 | 6/2010 | Bailey et al. | |
| 2010/0264157 | A1 | 10/2010 | Bailey et al. | |
| 2011/0168712 | A1 | 7/2011 | Bailey et al. | |

FOREIGN PATENT DOCUMENTS

| | | | |
|---|---|---|---|
| GB | 2 042 476 | | 9/1980 |
| WO | WO 99/48391 | A | 9/1999 |
| WO | WO 2004/035404 | A1 | 4/2004 |
| WO | WO 2005/016036 | A1 | 2/2005 |
| WO | WO 2005/030606 | A1 | 4/2005 |
| WO | WO 2005/035390 | A1 | 4/2005 |
| WO | WO 2007/017761 | A2 | 2/2007 |
| WO | WO 2007/067953 | A2 | 6/2007 |
| WO | WO 2007/070867 | A2 | 6/2007 |
| WO | WO 2008/070032 | A2 | 6/2008 |

* cited by examiner

DISPENSING CONTAINER

CROSS-REFERENCE TO RELATED APPLICATIONS

This application is a continuation-in-part of U.S. patent application Ser. No. 29/356,296, filed Feb. 23, 2010 now U.S. Pat. No. Des. 631,353, U.S. patent application Ser. No. 29/356,298, filed Feb. 23, 2010 U.S. Pat. No. Des. 631,747, and U.S. patent application Ser. No. 29/356,300, filed Feb. 23, 2010 now U.S. Pat. No. Des. 631,354, each of which is hereby incorporated herein by reference in its entirety.

FIELD OF THE INVENTION

The present invention relates to containers and methods of use thereof. More particularly, the invention relates to containers that provide dispensing or dosing of the stored product.

BACKGROUND OF THE INVENTION

Various types of containers for dispensing solid objects, particularly solid products intended for human consumption, are known in the art. Such containers are often characterized by a hand-held size that can be easily stored and transported. Exemplary consumable products that are often packaged in such containers include pharmaceutical compositions, oral tobacco products, snacks, mints, gums, breath strips, candy, and the like.

Certain consumable products, such as pharmaceutical products, require containers having a certain level of child resistance. Traditionally, pills have been packaged in a bottle having a cap that can only be removed by applying downward pressure while twisting the cap. However, this type of child resistance has certain disadvantages. For example, if a child does manage to open the bottle, immediate access is provided to the entire contents of the bottle. Further, if an adult user fails to place the cap in the properly secured position, there is no secondary mechanism for preventing access by a child.

Exemplary containers that provide a locking mechanism for enhancing child-resistance of a container can be found, for example, in U.S. Pat. No. 6,863,175 to Gelardi; U.S. Pat. No. 6,913,149 to Gelardi et al.; U.S. Pat. No. 6,976,576 to Intini; and U.S. Pat. No. 7,216,776 to Gelardi; U.S. Pat. Publication Nos. 2009/0223989 to Gelardi and 2009/0266837 to Gelardi et al.; and U.S. patent application Ser. Nos. 12/412,809 to Bailey et al.; 12/425,180 to Bailey et al.; and 12/685,819 to Bailey et al., which are incorporated herein by reference in their entirety.

In addition to child resistance, another desirable feature for certain containers is the ability to dispense a metered amount of a product. In other words, it can be highly desirable for the container to control dispensing such that only a defined number of stored product units, such as only a single unit, is dispensed each time the container is opened. Metered distribution of a product can be advantageous as a further level of child resistance as it prevents unrestricted access to the entire contents of the container, and as a means to improve sanitation because such a container negates the need to touch numerous units within the container in order to obtain a single desired unit.

Further, another desirable feature for certain containers is the protection of the product from environmental effects, particularly those effects that may degrade the product stored in the container. For example, in humid environments, moisture may invade the storage space housing the product, thereby damaging the product or otherwise rendering the product unusable.

There remains a need in the art for a container for storing and dispensing a product capable of combining various advantageous features, such as child resistance, moisture protection, metered dispensing, and convenient size.

BRIEF SUMMARY OF THE INVENTION

The present invention provides a container that, in certain embodiments, combines child-resistance with moisture protection, and which can be provided in a convenient handheld size. The type and form of the product to be stored and dispensed can vary.

In one embodiment, the container of the invention comprises an outer casing body having a cavity therein. The outer casing body includes first and second portions cooperatively configured such that the outer casing body is capable of moving between a closed and locked position and a dispensing position. A dispensing tray is disposed within the cavity of the outer casing body and has an outer peripheral portion. The dispensing tray includes an internal storage compartment adapted for storage of a plurality of units of a product to be dispensed. The dispensing tray has a cover portion defining at least one dispensing aperture through which a stored unit of product is accessible when the outer casing body is in the dispensing position. A sealing member is operably engaged with one of the outer casing body and the dispensing tray. The sealing member is configured to interact with the other of the outer casing body and the dispensing tray to form a seal about the outer peripheral portion of the dispensing tray when the outer casing body is in the closed and locked position. A locking mechanism operably engaged with the outer casing body is configured to releasably lock the outer casing body in the closed and locked position.

In another aspect, the invention provides a method of dispensing at least one unit of a product from a container, the method comprising the steps of:

providing a container in a closed and locked position, the container comprising:

an outer casing body having a cavity therein, the outer casing body having first and second portions cooperatively configured such that the outer casing body is capable of moving between a closed and locked position and a dispensing position;

a dispensing tray disposed within the cavity of the outer casing body and having an outer peripheral portion, the dispensing tray comprising an internal storage compartment adapted for storage of a plurality of units of a product to be dispensed, the dispensing tray having a cover portion defining at least one dispensing aperture through which a stored unit of product is accessible when the outer casing body is in the dispensing position;

a sealing member operably engaged with one of the outer casing body and the dispensing tray, the sealing member being configured to interact with the other of the outer casing body and the dispensing tray to form a seal about the outer peripheral portion of the dispensing tray when the outer casing body is in the closed and locked position; and a locking mechanism operably engaged with the outer casing body and configured to releasably lock the outer casing body in the closed and locked position;

releasing the locking mechanism so as to effectuate separation of the first and second portions of the outer casing body to the dispensing position; and removing at least one unit of product from the internal storage compartment.

In yet another aspect, the invention provides a method of sealing a product in a container, the method comprising the steps of:

providing a container in a dispensing position, the container comprising:

an outer casing body having a cavity therein, the outer casing body having first and second portions cooperatively configured such that the outer casing body is capable of moving between a closed and locked position and a dispensing position;

a dispensing tray disposed within the cavity of the outer casing body and having an outer peripheral portion, the dispensing tray comprising an internal storage compartment adapted for storage of a plurality of units of a product to be dispensed, the dispensing tray having a cover portion defining at least one dispensing aperture through which a stored unit of product is accessible when the outer casing body is in the dispensing position;

a sealing member operably engaged with one of the outer casing body and the dispensing tray, the sealing member being configured to interact with the other of the outer casing body and the dispensing tray to form a seal about the outer peripheral portion of the dispensing tray when the outer casing body is in the closed and locked position; and a locking mechanism operably engaged with the outer casing body and configured to releasably lock the outer casing body in the closed and locked position; and engaging the locking mechanism such that the first and second portions of the outer casing body enclose the dispensing tray and the sealing member sealingly engages the other of the outer casing body and the dispensing tray.

These and other features, aspects, and advantages of the invention will be apparent from a reading of the following detailed description together with the accompanying drawings, which are briefly described below.

BRIEF DESCRIPTION OF THE DRAWINGS

Figure 1A:
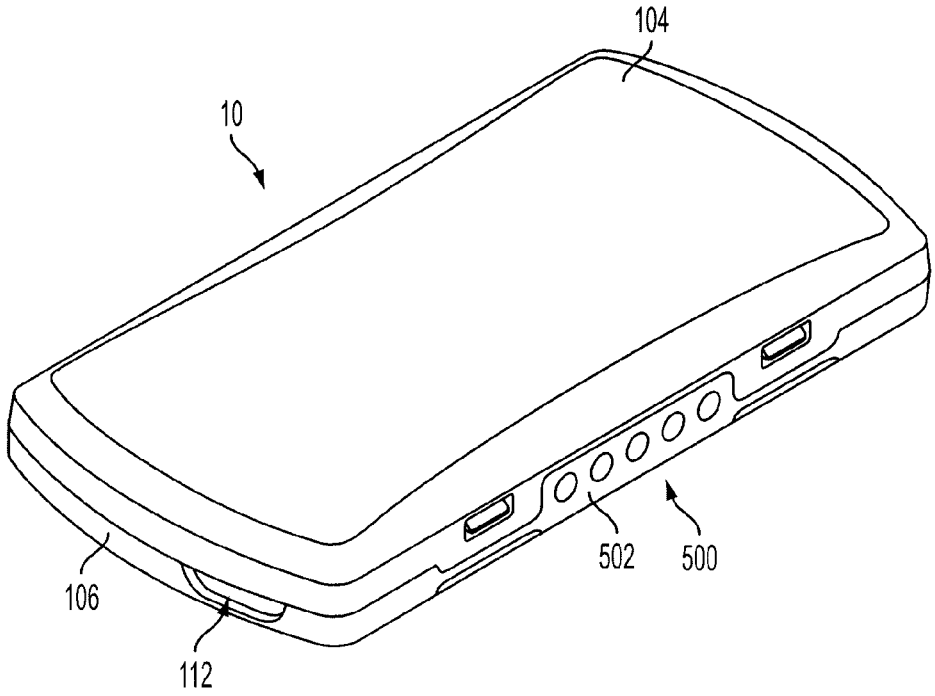
Figure 1B:
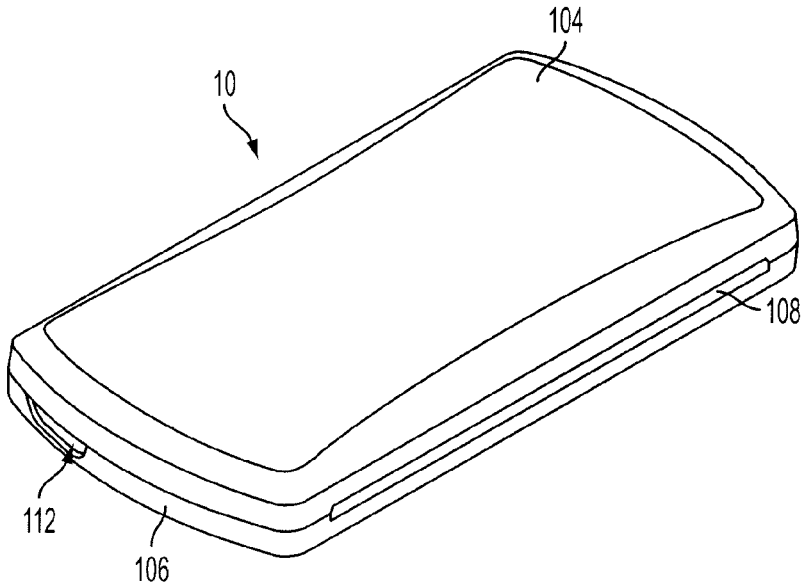
Figure 2A:
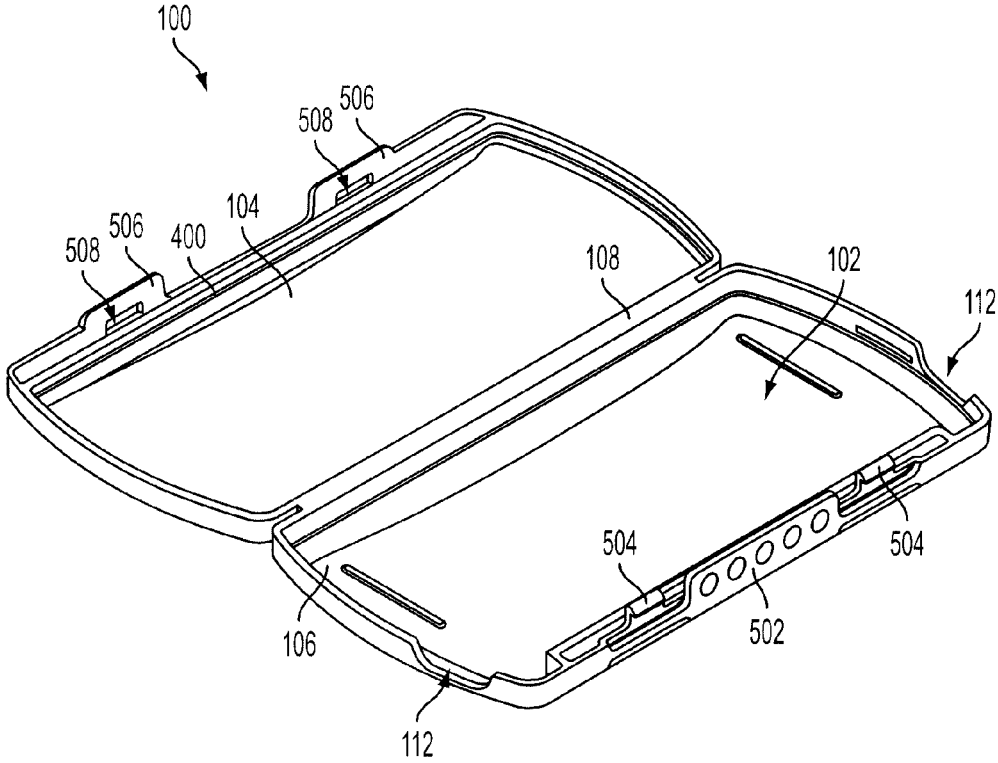
Figure 2B:
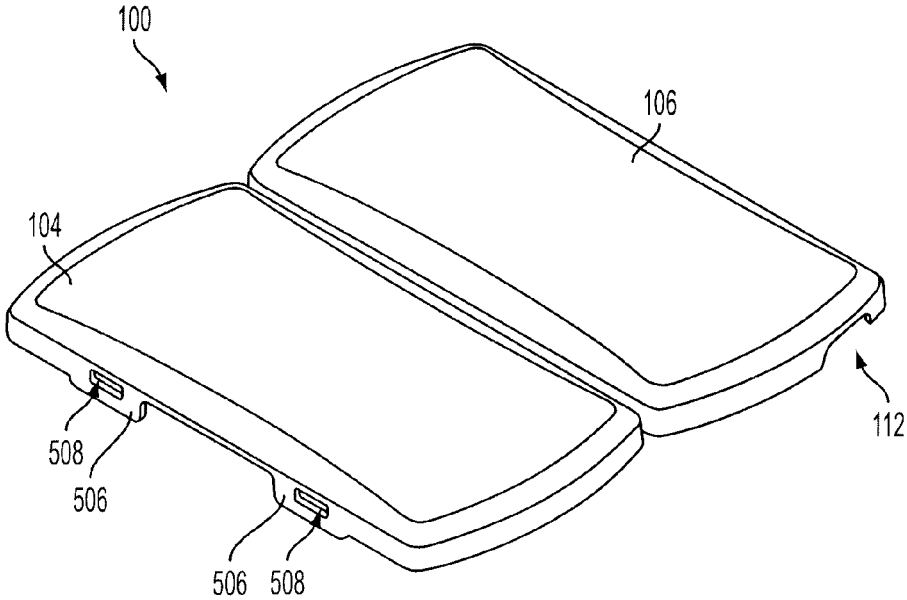
Figure 3A:
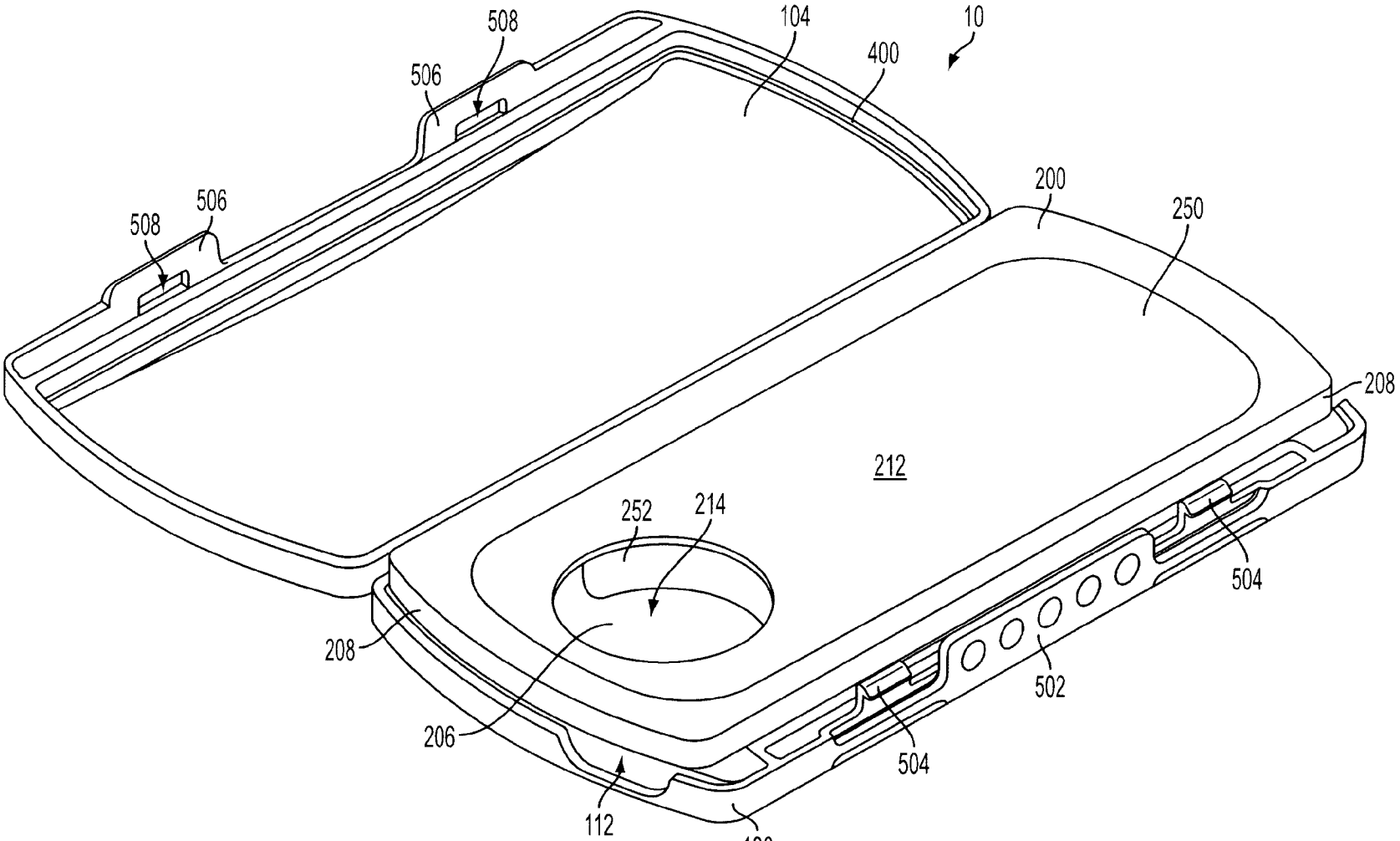
Figure 3B:
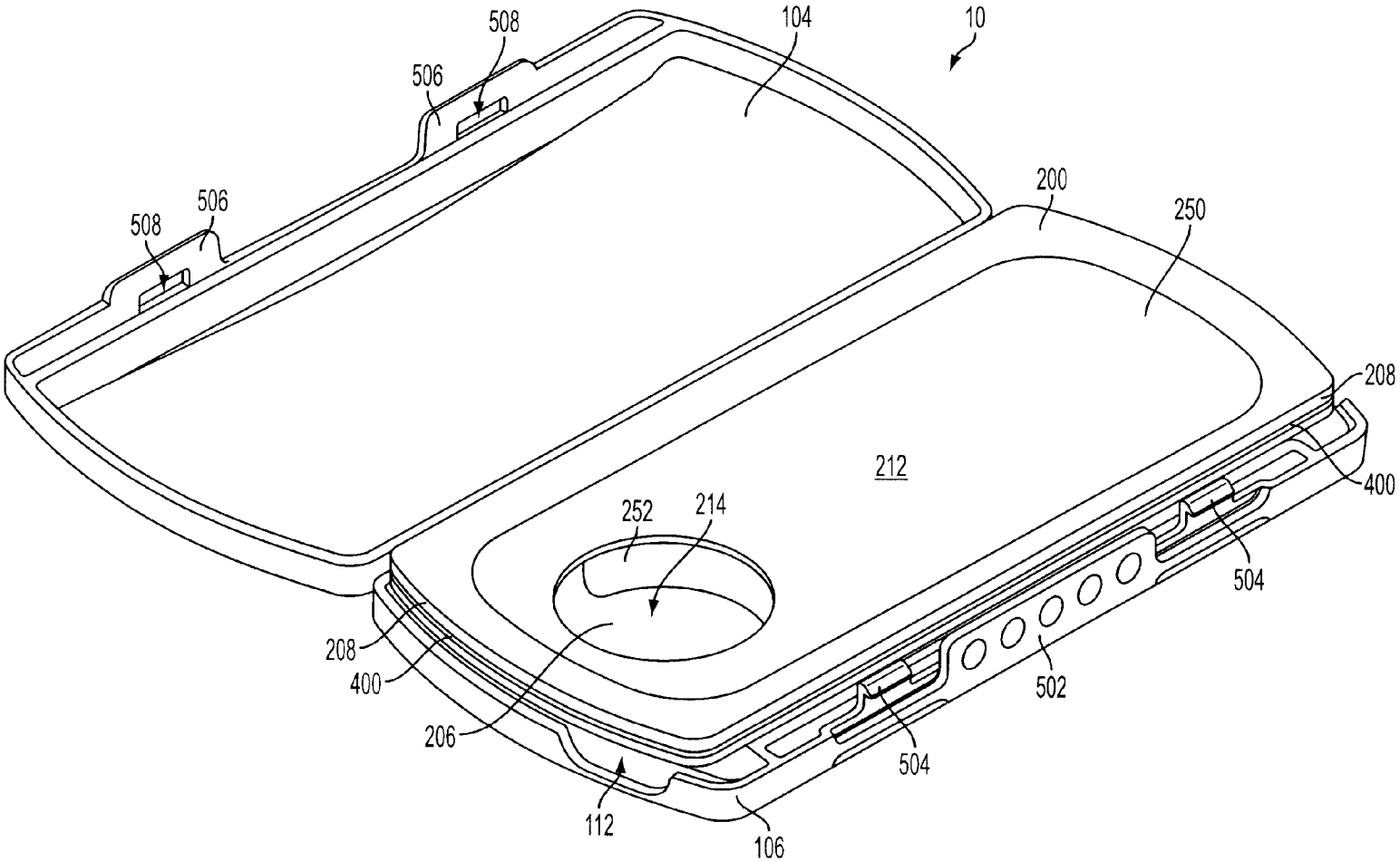
Figure 4:
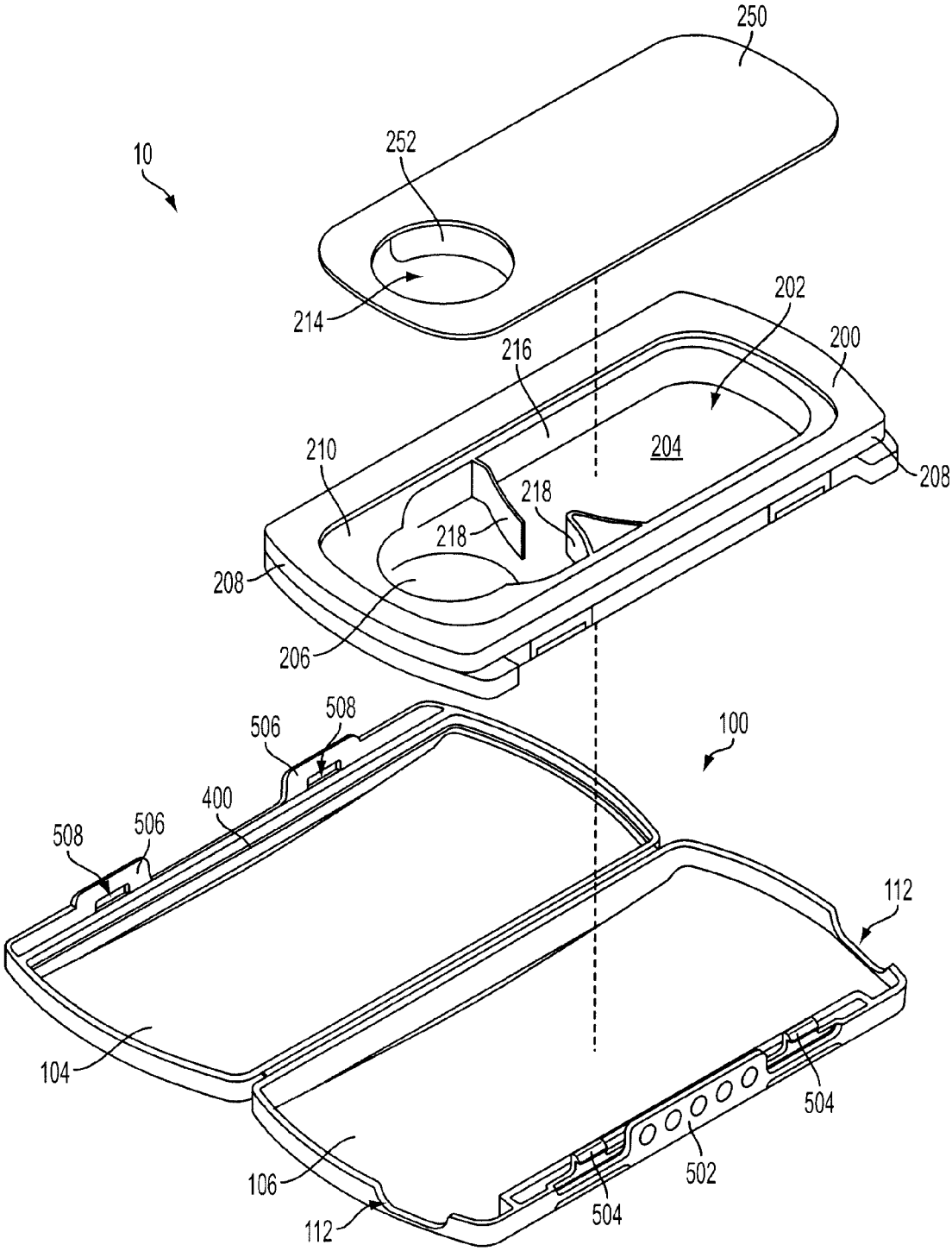
Figure 5:
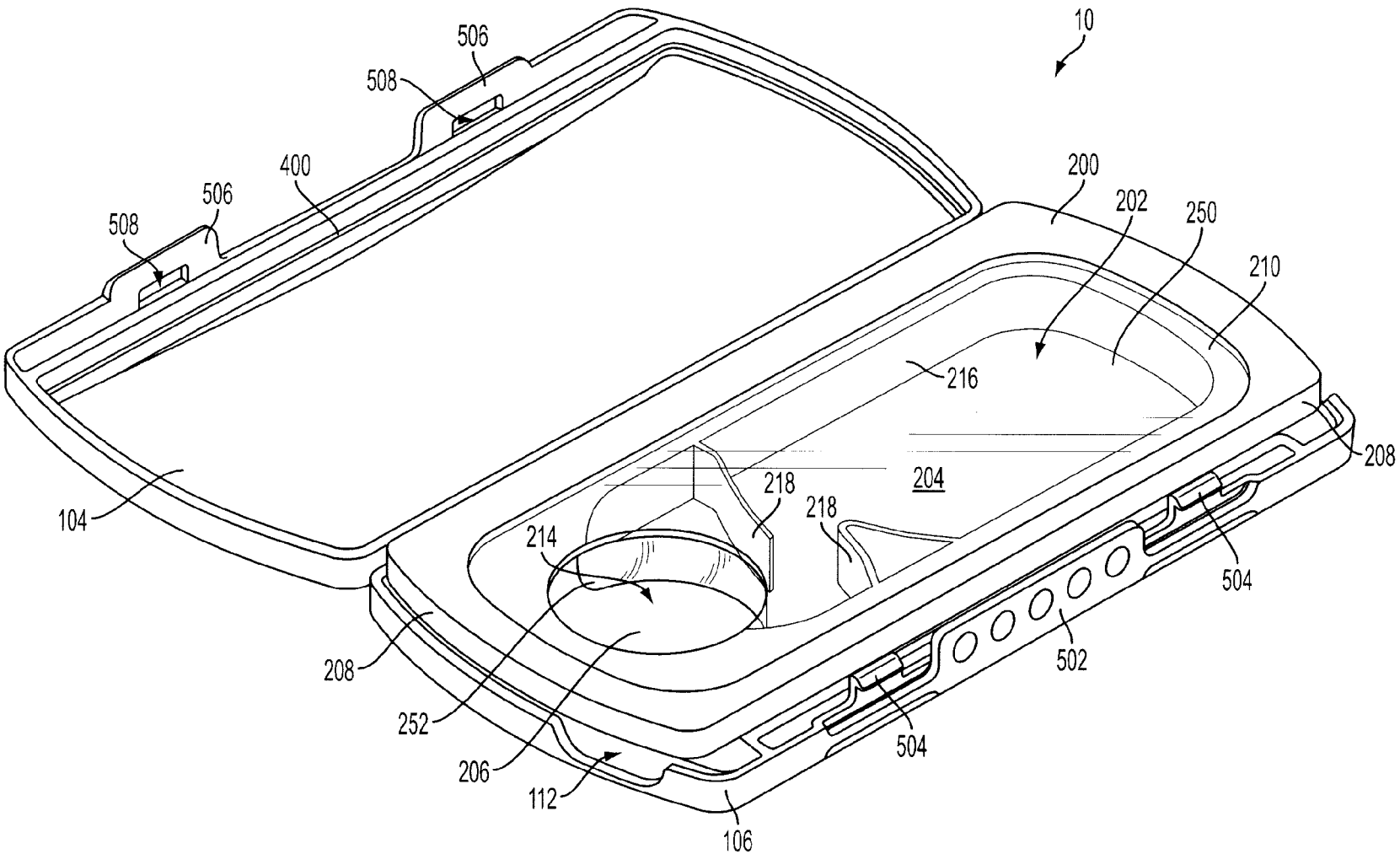
Figure 6:
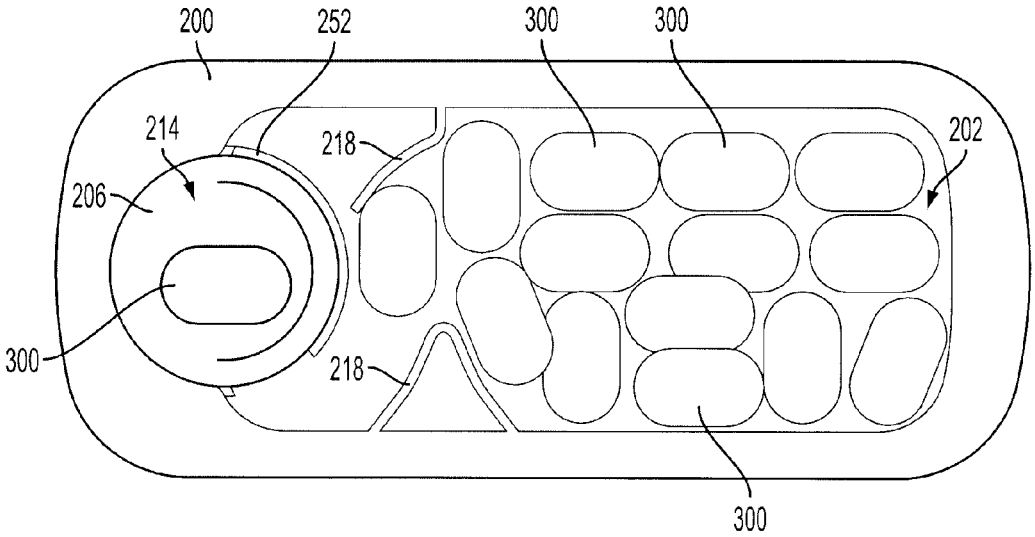
Figure 7:
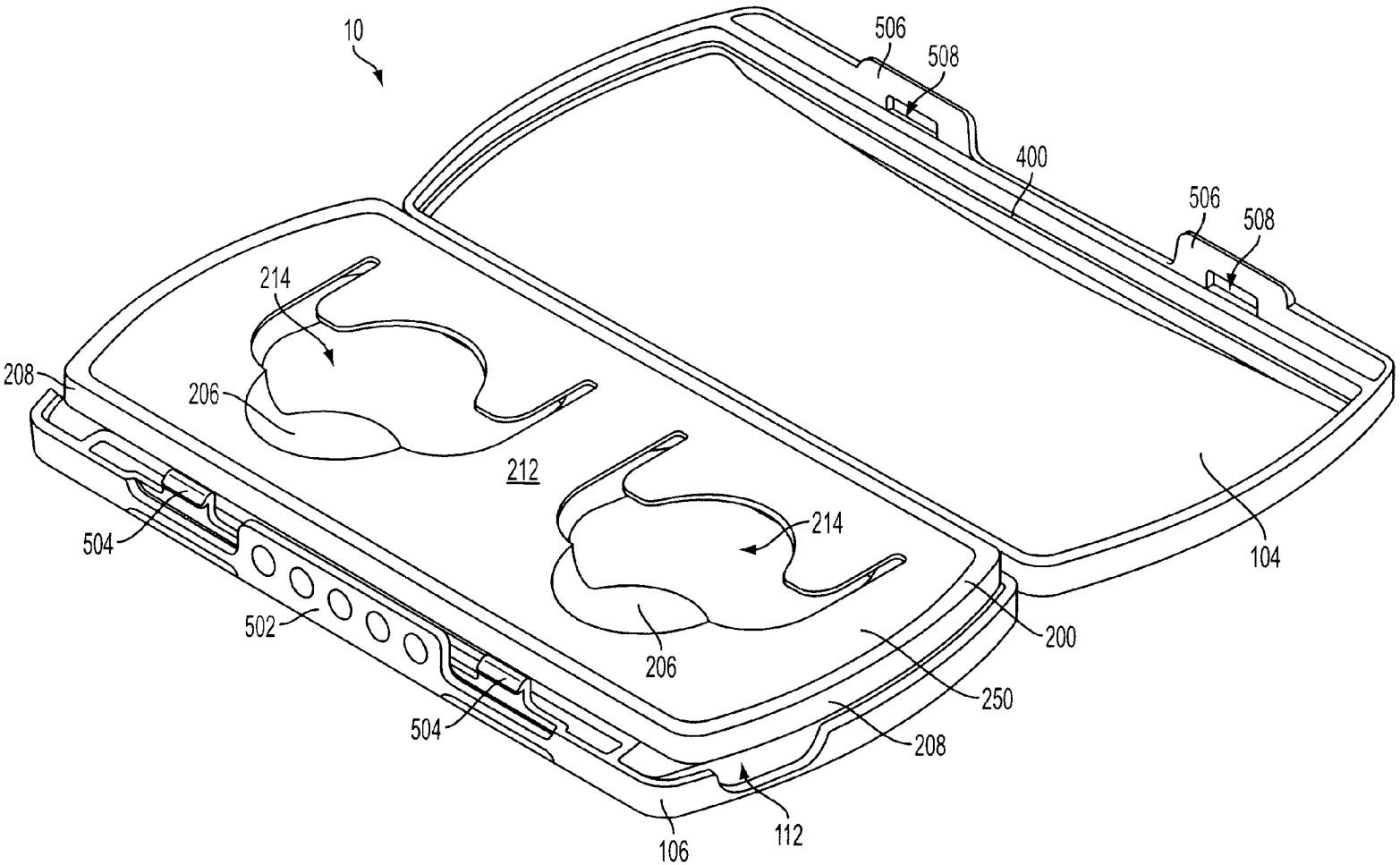
Figure 8:
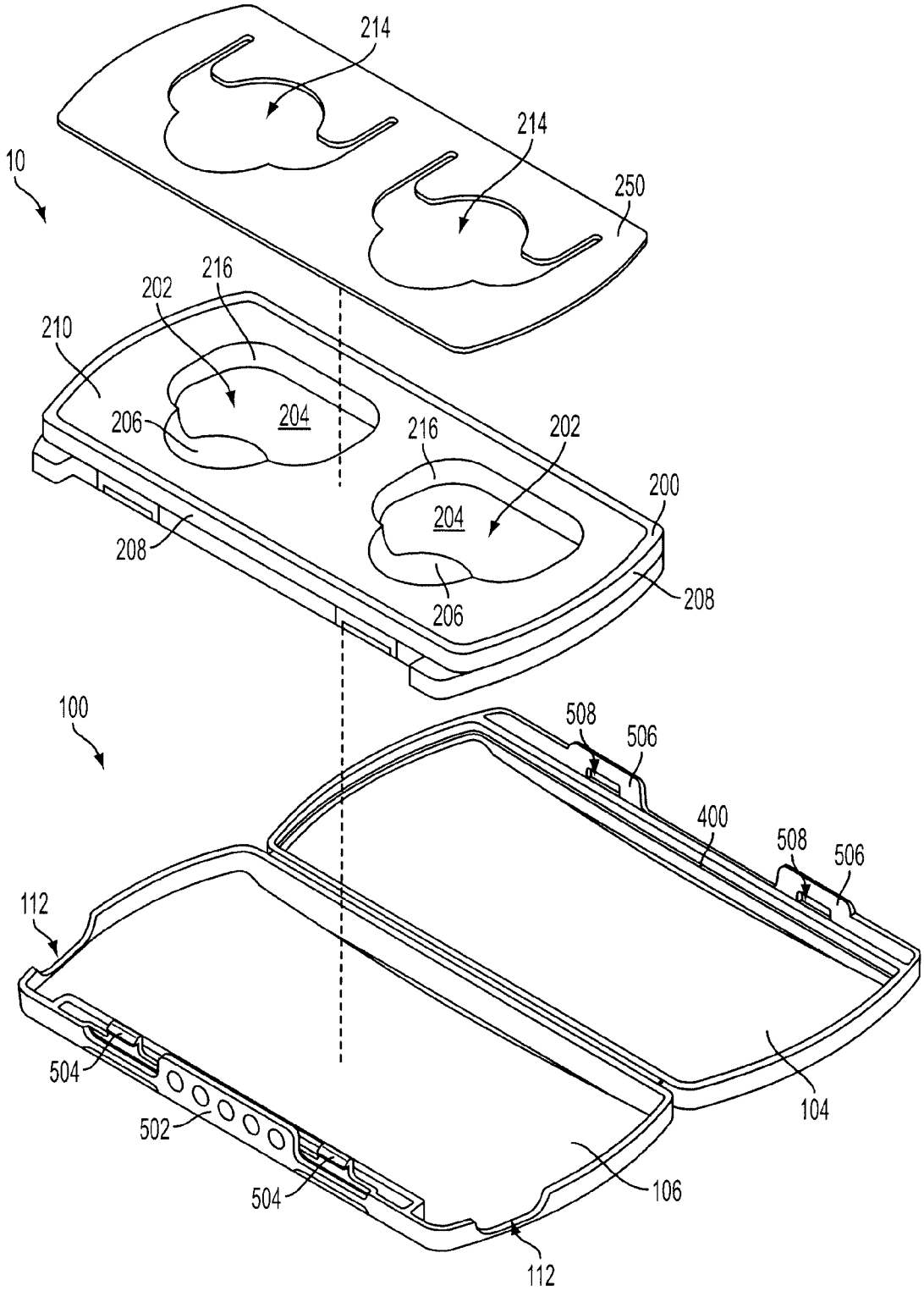
Figure 9:
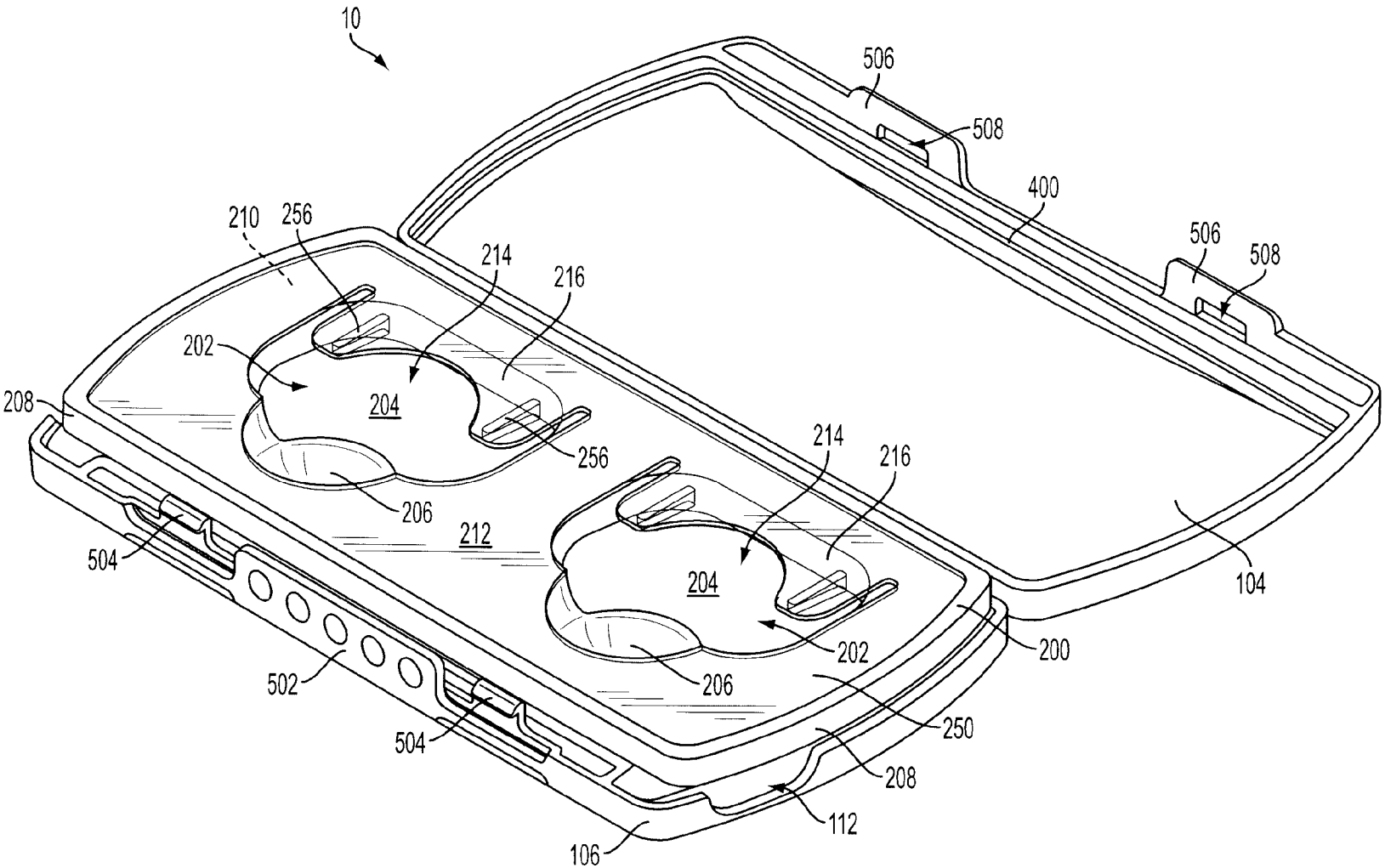
Figure 10:
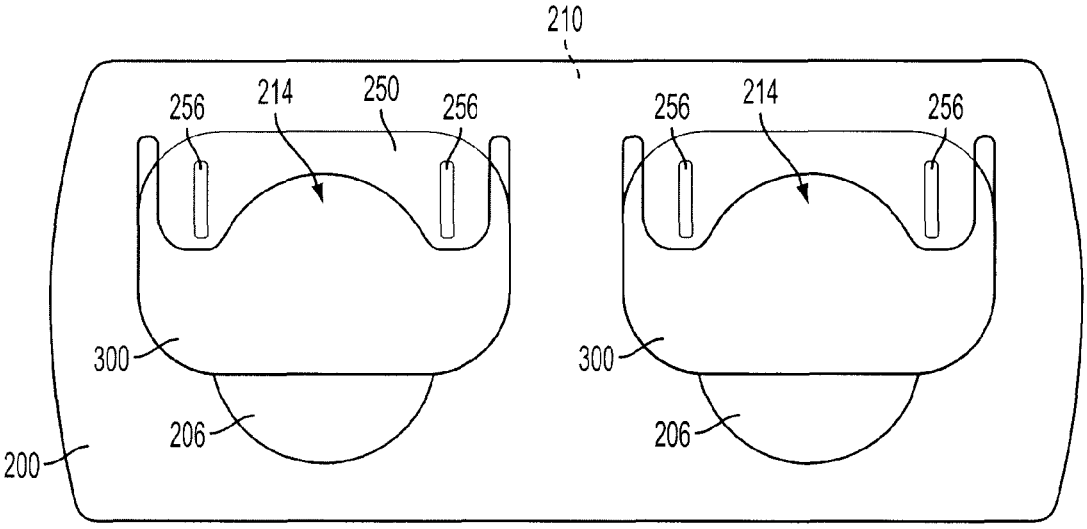
Figure 11:
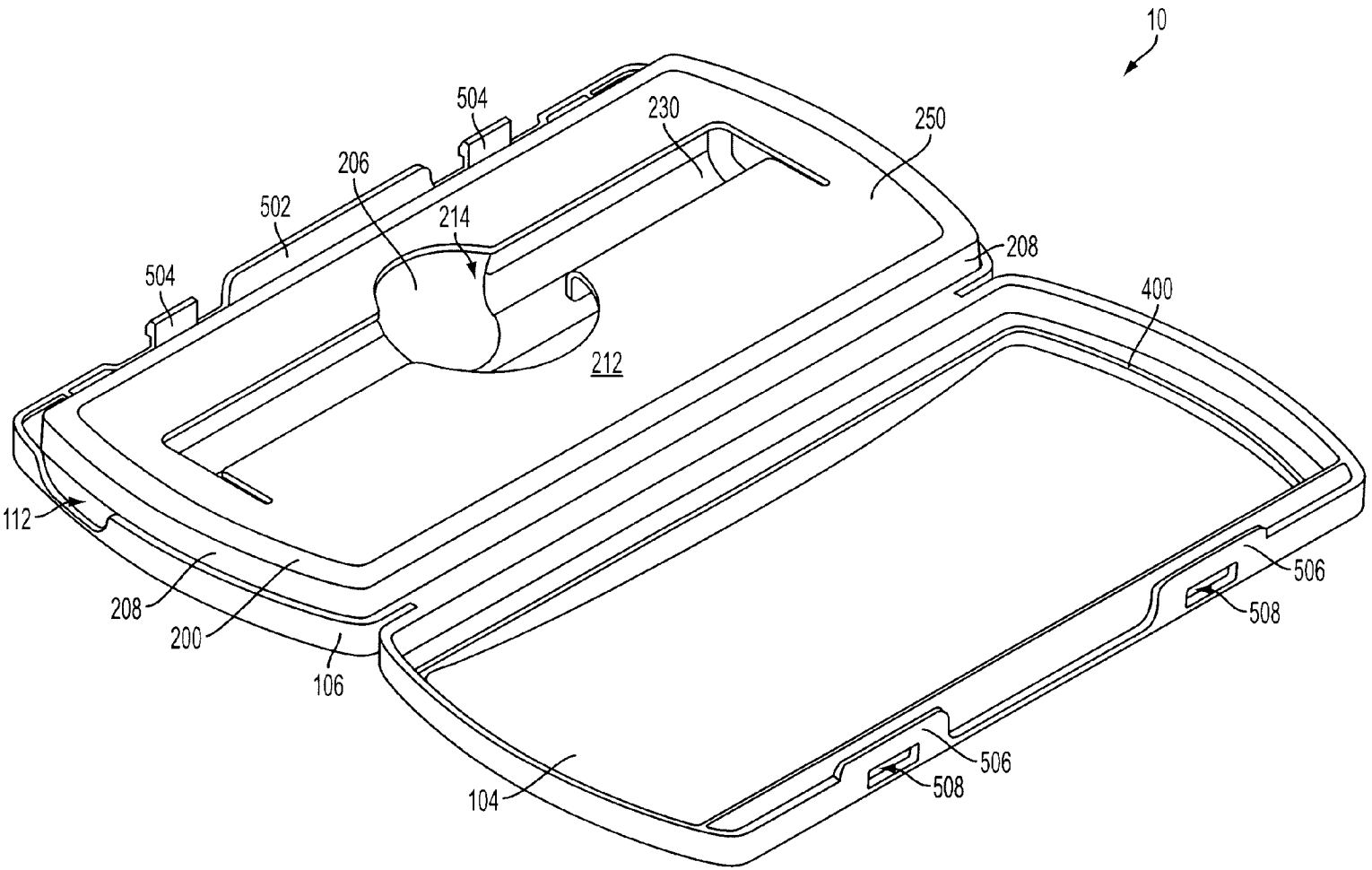
Figure 12:
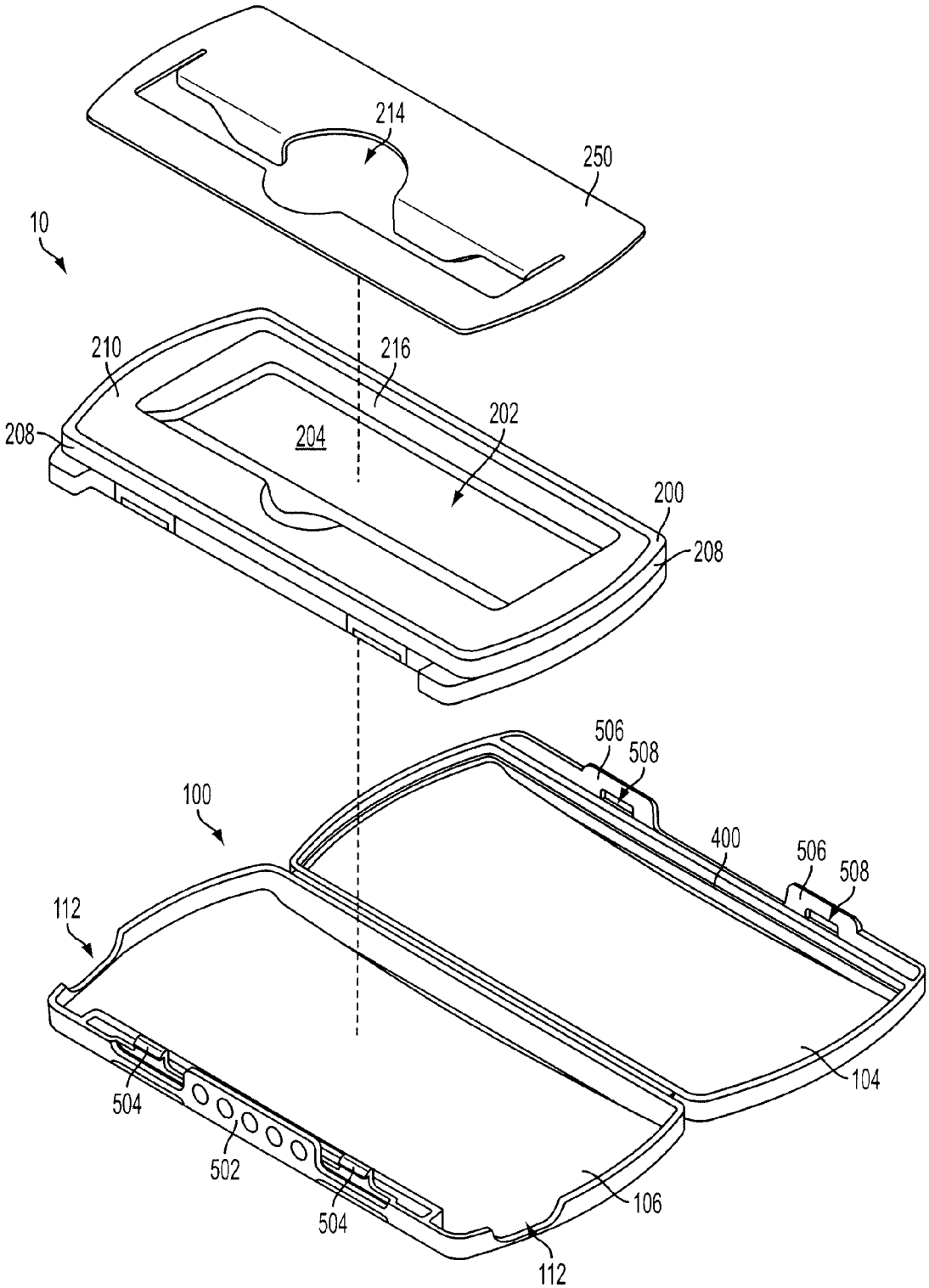
Figure 13:
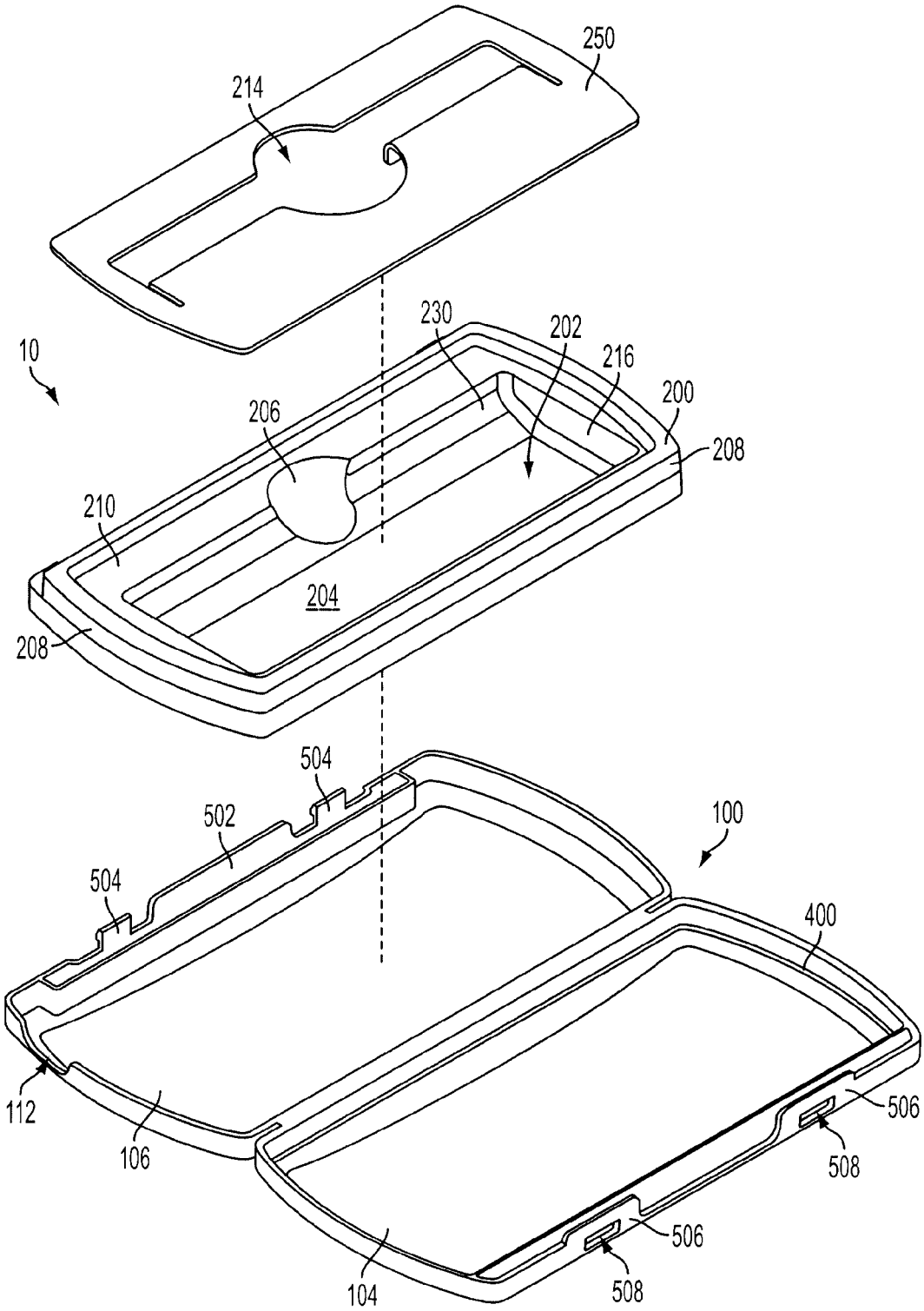
Figure 14:
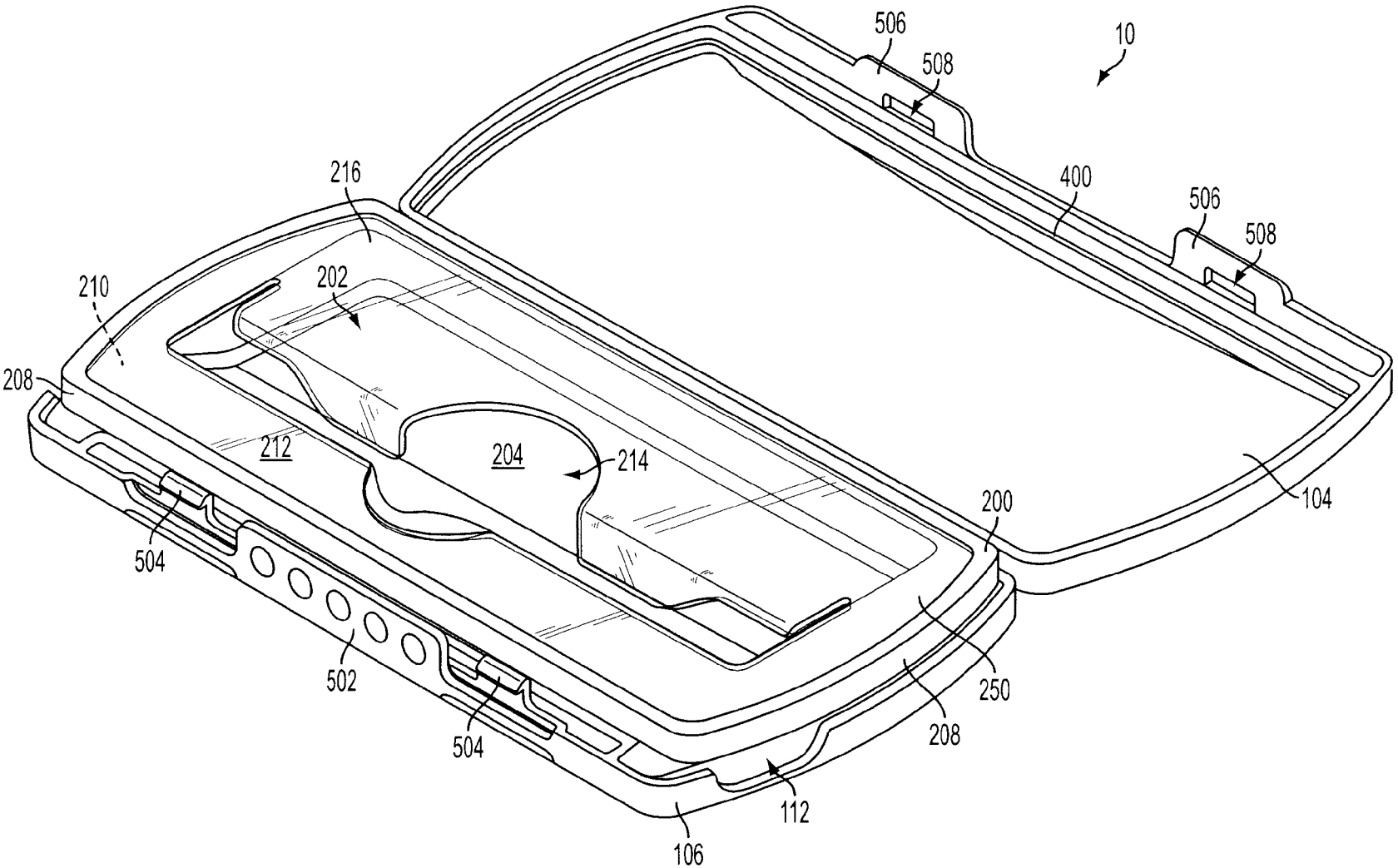
Figure 15:
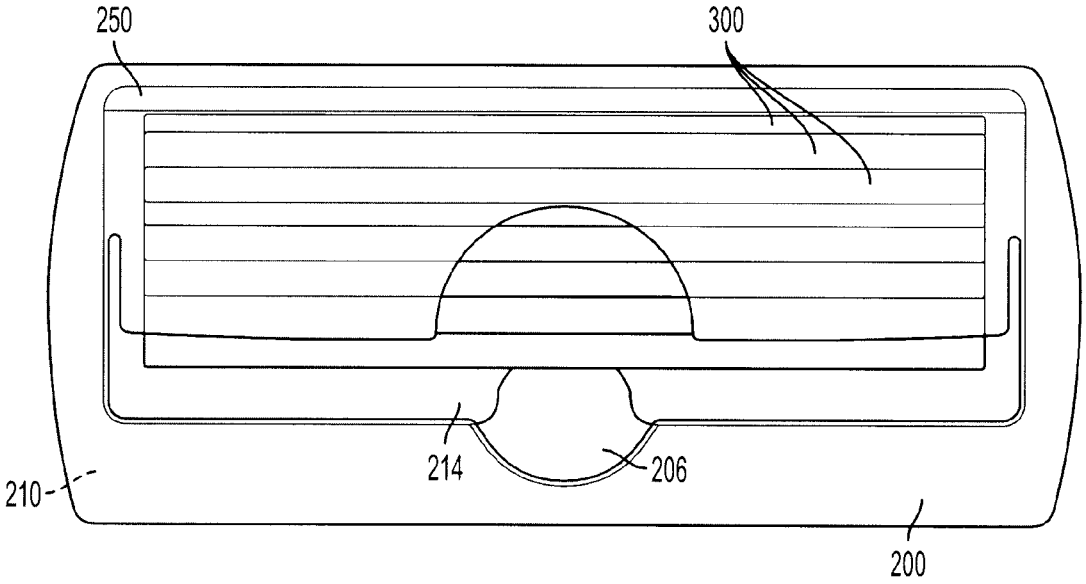
Figure 16:
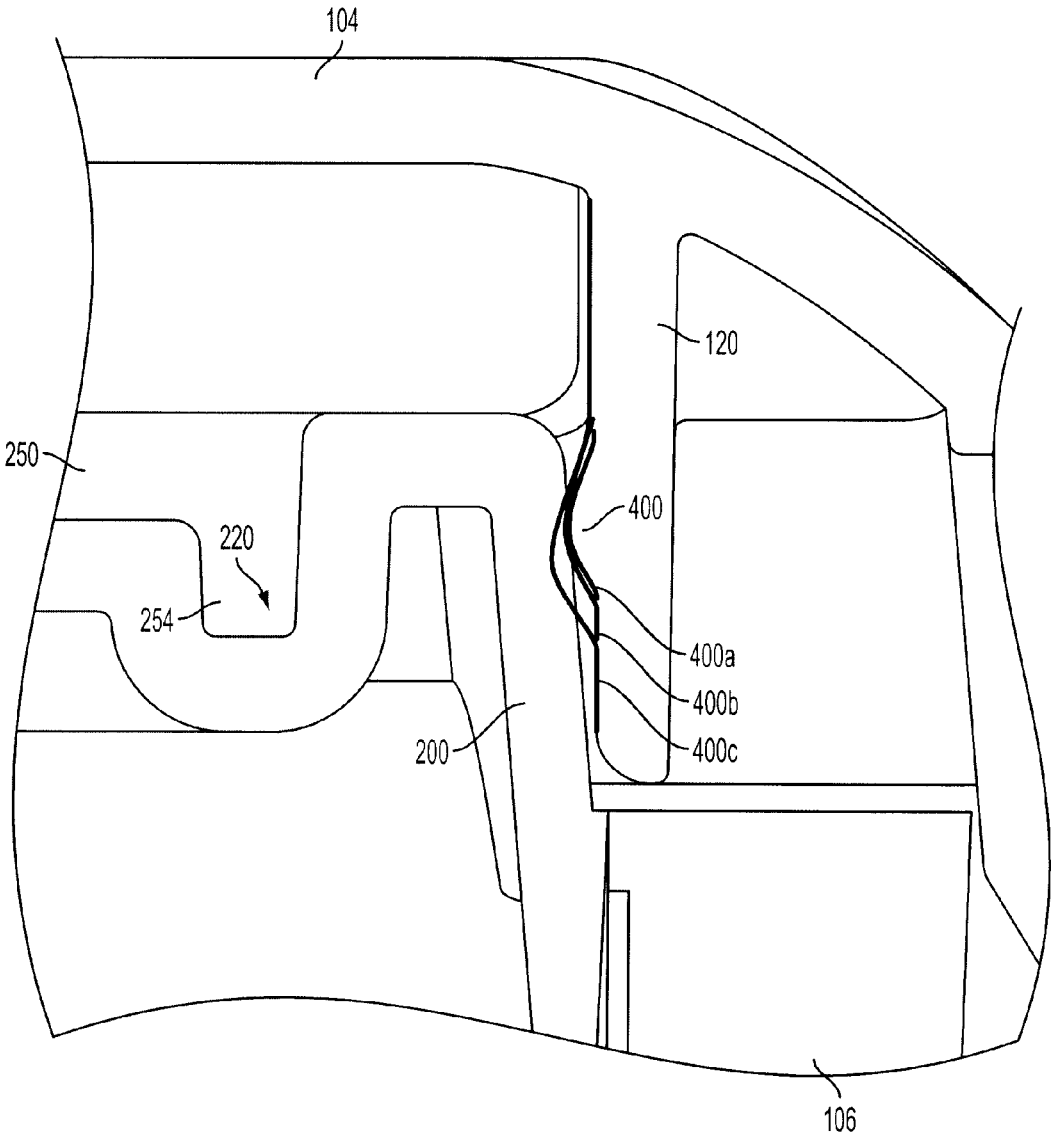
Figure 17A:
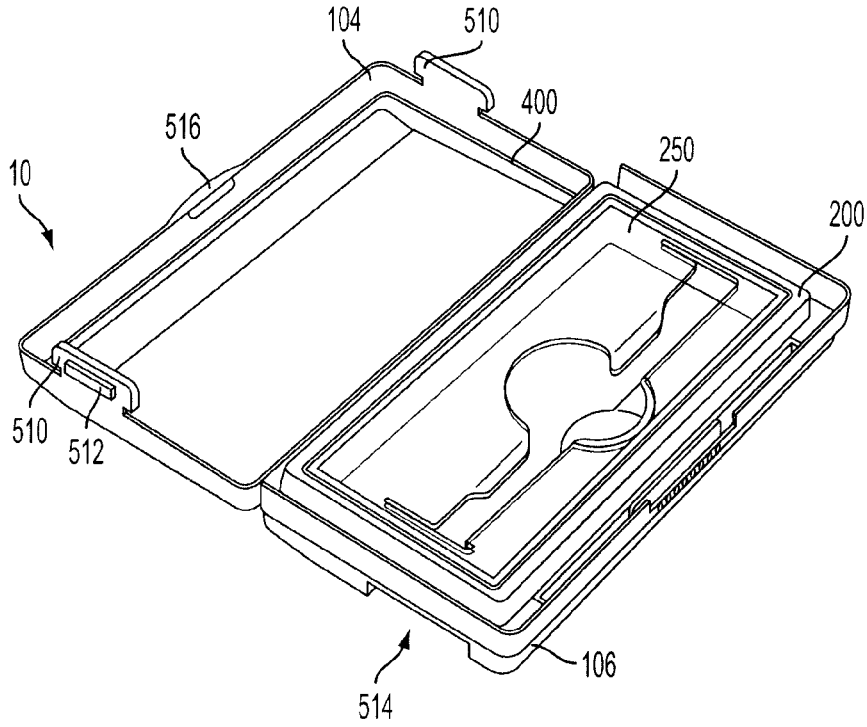
Figure 17B:
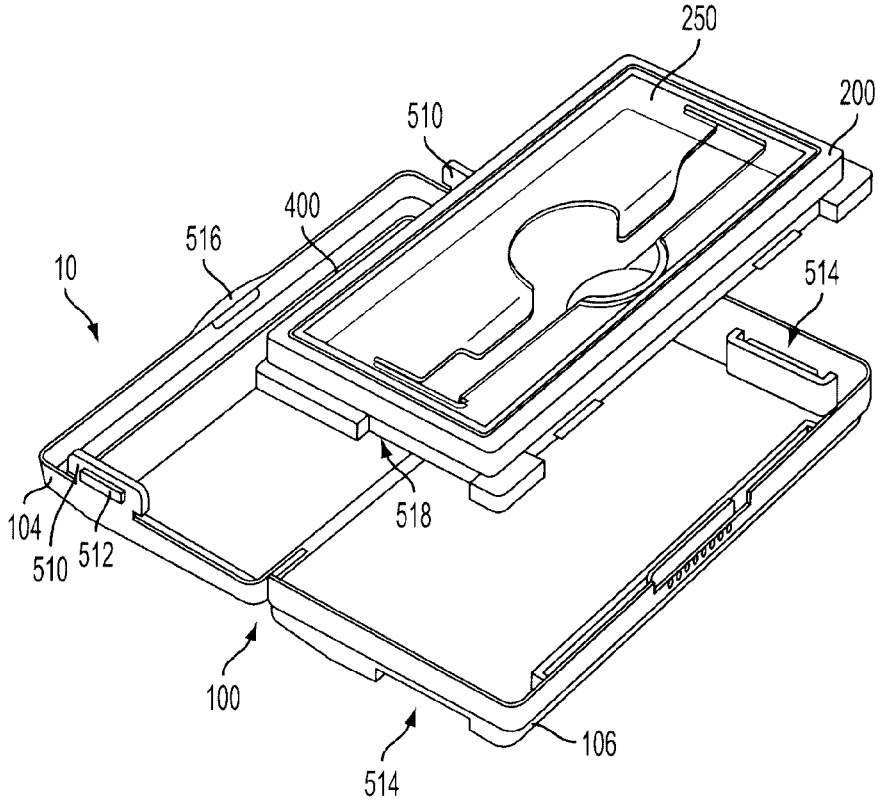
Figure 18:
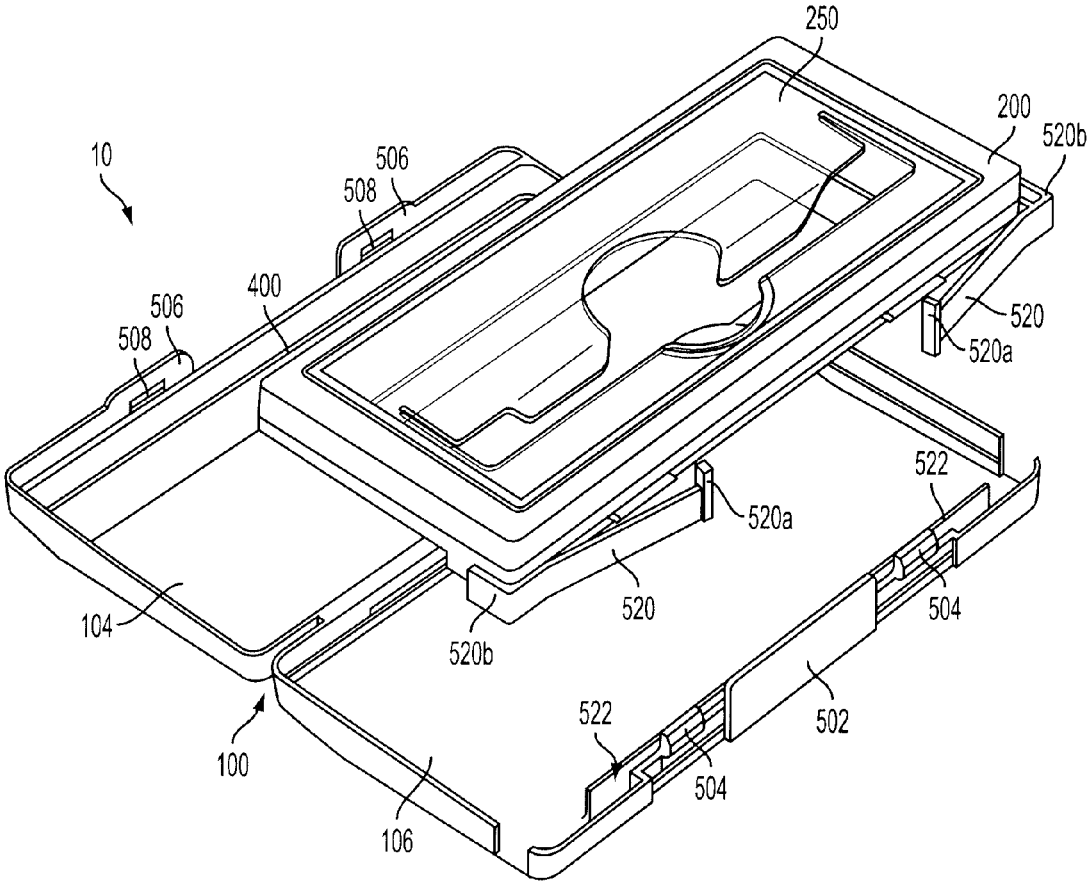
Figure 19A:
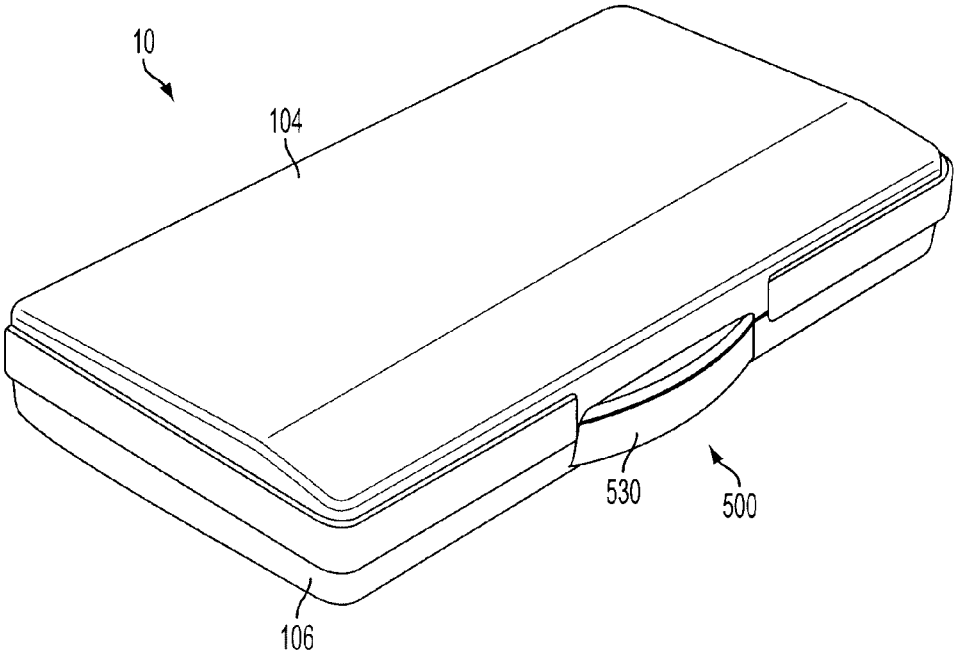
Figure 19B:
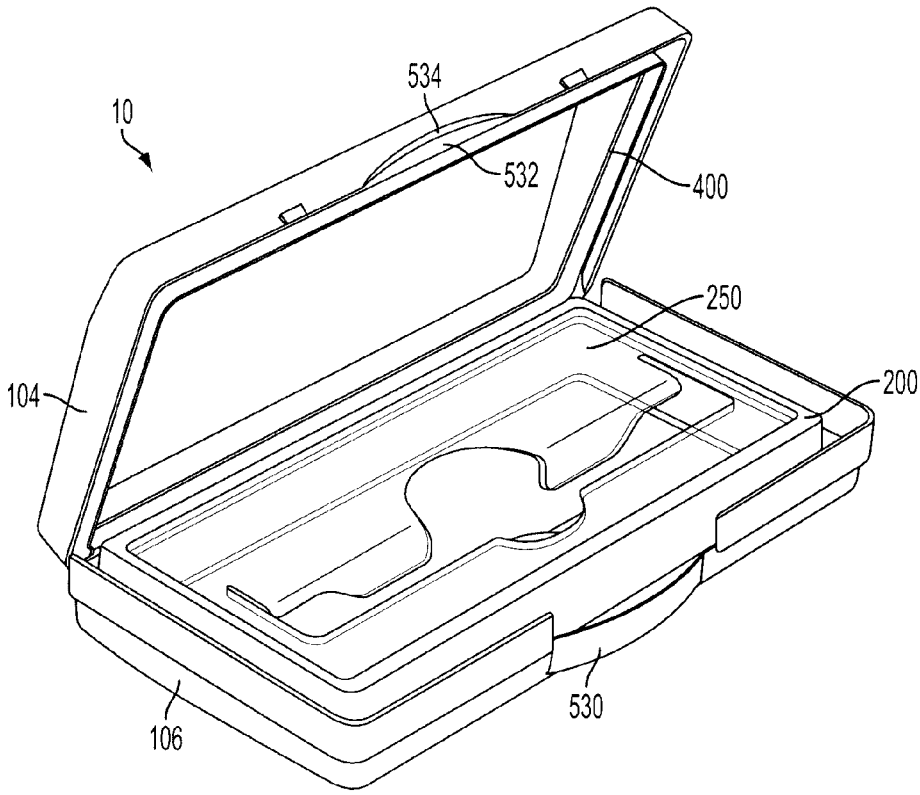
Figure 20A:
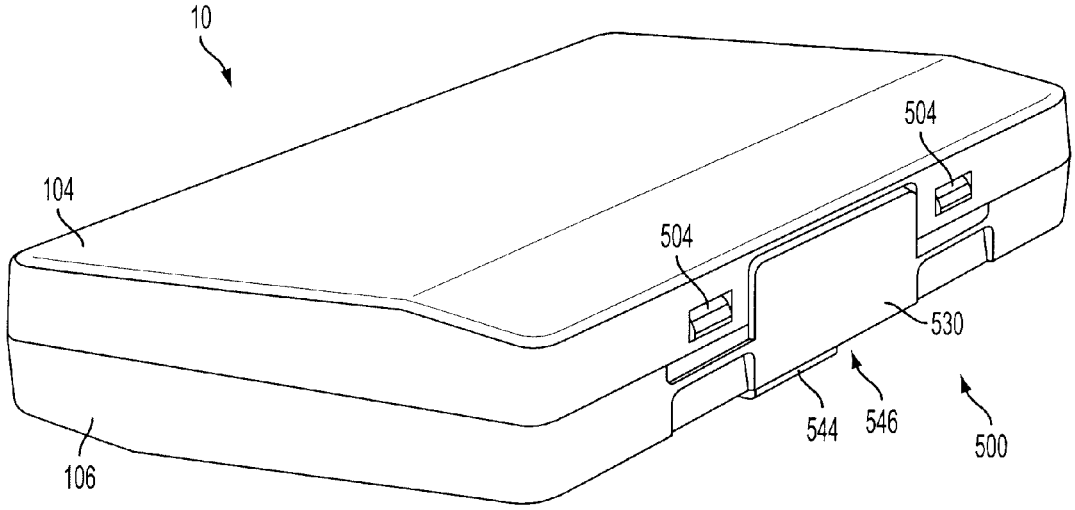
Figure 20B:
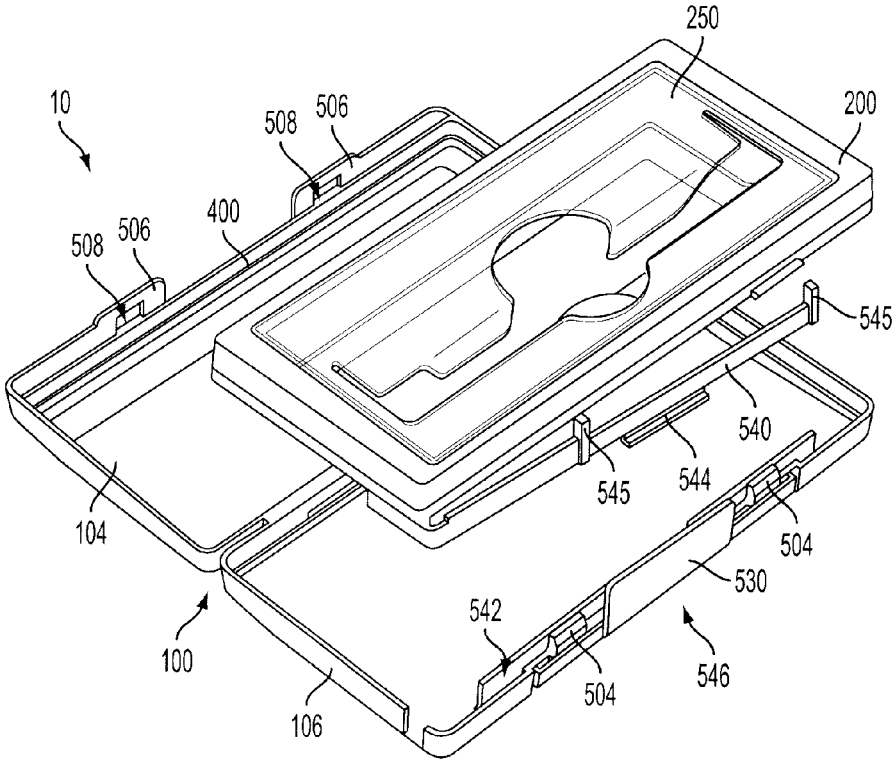
Figure 20C:
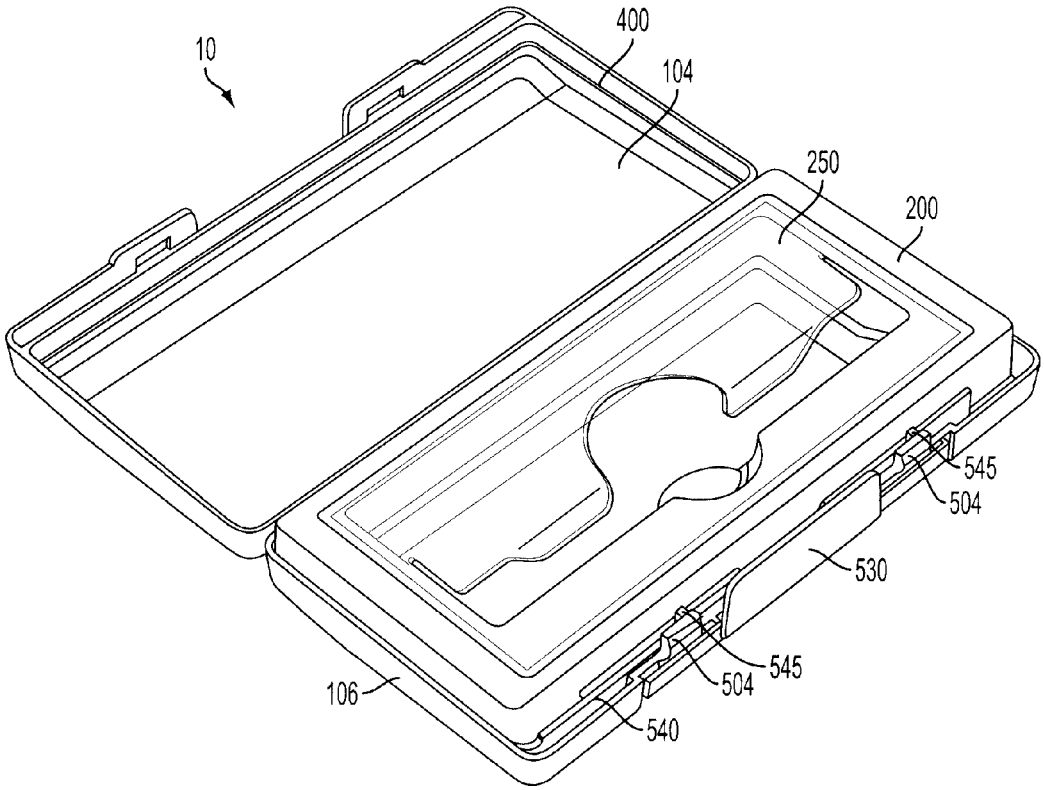
Figure 21:
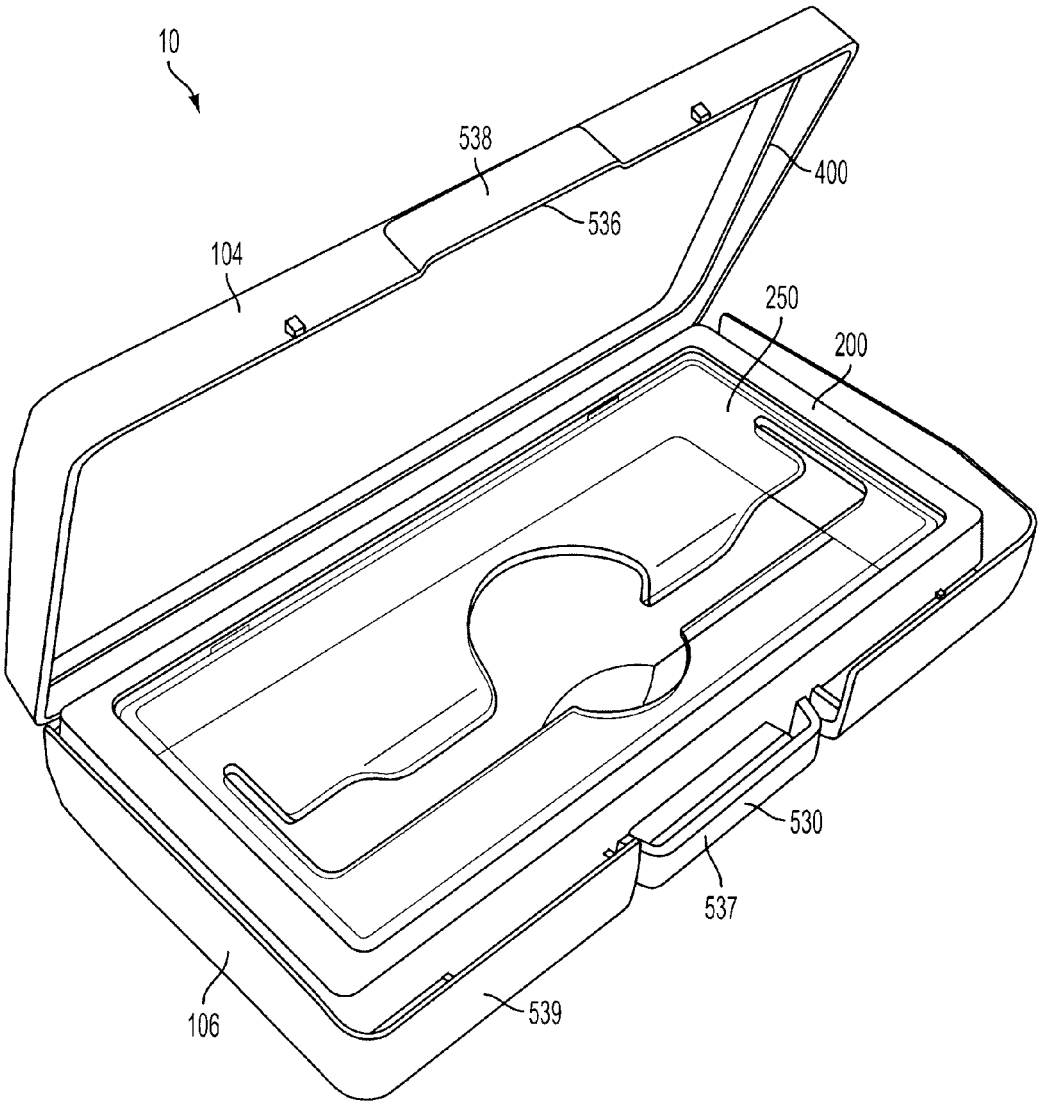

Having thus described the invention in general terms, reference will now be made to the accompanying drawings, which are not necessarily drawn to scale, and wherein:

FIG. 1A is a front perspective view of a container embodiment of the invention in a locked and closed position;

FIG. 1B is a rear perspective view of the container embodiment of FIG. 1A;

FIG. 2A is a top perspective view of an outer casing body of a container embodiment of the invention in an open position;

FIG. 2B is a bottom perspective view of the outer casing body of FIG. 2A;

FIG. 3A is a perspective view of one container embodiment of the invention in an open position and having an opaque cover portion, with a sealing member provided on an outer casing body;

FIG. 3B is a perspective view of the container embodiment of FIG. 3A with the sealing member provided on a dispensing tray;

FIG. 4 is an exploded view of the container embodiment of FIG. 3A;

FIG. 5 is a perspective view of the container embodiment of FIG. 3A with a non-opaque cover portion;

FIG. 6 is a partial perspective view of a dispensing tray of the container embodiment of FIG. 3A with a plurality of product stored therein;

FIG. 7 is a perspective view of another container embodiment of the invention in an open position and having an opaque cover portion;

FIG. 8 is an exploded view of the container embodiment of FIG. 7;

FIG. 9 is a perspective view of the container embodiment of FIG. 7 with a non-opaque cover portion;

FIG. 10 is a partial perspective view of a dispensing tray of the container embodiment of FIG. 7 with a plurality of product stored therein;

FIG. 11 is a perspective view of yet another container embodiment of the present invention in an open position and having an opaque cover portion;

FIG. 12 is an exploded front view of the container embodiment of FIG. 11;

FIG. 13 is an exploded rear view of the container embodiment of FIG. 11;

FIG. 14 is a perspective view of the container embodiment of FIG. 11 with the cover portion being non-opaque;

FIG. 15 is a partial perspective view of a dispensing tray of the container embodiment of FIG. 11 with a plurality of product stored therein;

FIG. 16 is a partial cross-sectional view of a container embodiment of the invention illustrating the interaction of an outer casing body and a dispensing tray to form a seal;

FIG. 17A is a perspective view of a container with one locking mechanism embodiment of the invention;

FIG. 17B is an exploded view of the container of FIG. 17A;

FIG. 18 is a perspective view of a container with another locking mechanism embodiment of the invention;

FIG. 19A is a perspective view of a container with yet another locking mechanism embodiment of the invention;

FIG. 19B is an exploded view of the container of FIG. 19A;

FIG. 20A is a perspective view of a container with still another locking mechanism embodiment of the invention, the container being shown in a locked and closed position;

FIG. 20B is an exploded view of the container of FIG. 20A;

FIG. 20C is a perspective view of the container of FIG. 20A with the container being shown in an open position; and FIG. 21 is a perspective view of a container with still yet another locking mechanism embodiment of the invention.

DETAILED DESCRIPTION OF THE INVENTION

The present invention now will be described more fully hereinafter with reference to certain preferred embodiments. These embodiments are provided so that this disclosure will be thorough and complete, and will fully convey the scope of the invention to those skilled in the art. Indeed, the invention may be embodied in many different forms and should not be construed as limited to the embodiments set forth herein; rather, these embodiments are provided so that this disclosure will satisfy applicable legal requirements. As used in the specification, and in the appended claims, the singular forms "a", "an", "the", include plural referents unless the context clearly dictates otherwise.

The container embodiments described in the present application can be used to store and dispense any solid products, but are particularly well-suited for products designed for oral consumption. Exemplary consumable products include pharmaceutical products such as pills and tablets, cigarettes and other smoking products, smokeless tobacco products, candies, mints, gums and other confectionary products, snacks, and the like.

Exemplary tobacco products include pelletized tobacco products (e.g., compressed or molded pellets produced from powdered or processed tobacco, such as those formed into the general shape of a coin, cylinder, bean, pellet, sphere, orb, strip, obloid, cube, bead, or the like), extruded or cast pieces of tobacco (e.g., as strips, films or sheets, including multilayered films formed into a desired shape), products incorporating tobacco carried by a solid substrate (e.g., where substrate materials range from edible grains to inedible cellulosic sticks), extruded or formed tobacco-containing rods or sticks, tobacco-containing capsule-like materials having an outer shell region and an inner core region, straw-like (e.g., hollow formed) tobacco-containing shapes, sachets or packets containing tobacco (e.g., snus-like products), pieces of tobacco-containing gum, and the like.

Exemplary smokeless tobacco compositions that can be packaged in the containers of the invention are set forth in, for example, U.S. Pat. No. 1,376,586 to Schwartz; U.S. Pat. No. 3,368,567 to Speer; U.S. Pat. No. 4,513,756 to Pittman et al.; U.S. Pat. No. 4,606,357 to Dusek et al; U.S. Pat. No. 4,821,749 to Toft et al.; U.S. Pat. No. 5,167,244 to Kjerstad; U.S. Pat. No. 5,387,416 to White; U.S. Pat. No. 6,668,839 to Williams; US 2005/0244521 to Strickland et al.; US 2006/0191548 to Strickland et al.; US 2007/0186942 to Strickland et al.; US 2008/0029110 to Dube et al.; and US 2008/0029116 to Robinson et al. Examples of tobacco-containing gum are set forth in U.S. Pat. No. 4,624,269 to Story et al.; U.S. Pat. No. 4,975,270 to Kehoe; and U.S. Pat. No. 4,802,498 to Ogren. Various manners or methods for packaging smokeless tobacco products are set forth in US 2004/0217024 and US 2006/0118589 to Arnarp et al.; WO 2005/016036 to Bjorkholm; WO 2006/034450 to Budd; WO 2007/017761 to Kutsch et al.; and WO 2007/067953 to Sheveley et al. All of the above-cited references are incorporated by reference herein in their entirety.

Smokeless tobacco compositions utilized as the product contained in the containers of the invention will often include such ingredients as tobacco (typically in particulate form), sweeteners, binders, colorants, pH adjusters, fillers, flavoring agents, disintegration aids, antioxidants, oral care additives, and preservatives. See, for example, US 2007/0186941 to Holton et al., which is incorporated by reference herein in its entirety.

The size and shape of the product to be stored and dispensed can vary. Exemplary product shapes include pills, tablets, spheres, orbs, strips, films, sheets, coins, cubes, beads, ovoids, obloids, cylinders, bean-shaped, sticks, or rods. Cross-sectional shape of the products can vary, and exemplary cross-sectional shapes include circles, squares, ovals, rectangles, and the like. The dimensions of the product will often vary depending on its shape. In one embodiment, the product is pellet or bean-shaped, and has a length and width in the range of about 3 mm to about 20 mm, more typically about 5 to about 12 mm. In another embodiment, the product is rod-shaped with a length in the range of about 50 to about 100 mm (more typically about 60 to about 80 mm) and a diameter of about 2 mm to about 8 mm (more typically about 3 mm to about 6 mm).

In one embodiment, the product is in the form of a flattened sheet or film. The sheet-like or film material typically has a shape that can be described as generally rectangular (optionally with rounded corners or edges), oval, triangular, or diamond-shaped. A generally rectangular sheet or film product will typically have a length in the range of about 20 to about 40 mm, more often about 25 to about 35 mm, and in some cases, between about 30 and about 35 mm (e.g., about 33 mm). The width of a generally rectangular sheet or film product will typically range from about 12 to about 28 mm, more often about 15 to about 25 mm, and in some cases, between about 18 and about 22 mm (e.g., about 20 mm). The thickness of the sheet or film product is typically within the range of about 0.05 to about 0.75 mm, more often about 0.1 to about 0.5 mm, and in some cases, between about 0.15 and about 0.25 mm. Sheet-shaped products are typically arranged in a stacked configuration within the storage compartment of the containers of the invention.

When the product is a smokeless tobacco composition, the sheet or film product can take a variety of forms, including films or sheets formed using tobacco reconstitution techniques known in the art. Alternatively, the sheet or film product can be in the form of so-called "edible films" or "orally dissolvable strips" that incorporate a tobacco component. Exemplary sheet or film materials are set forth in U.S. Pat. No. 5,587,172 to Cherukuri et al.; U.S. Pat. No. 5,733,577 to Myers et al.; U.S. Pat. No. 5,869,098 to Misra et al.; U.S. Pat. No. 5,871,781 to Myers et al.; U.S. Pat. No. 6,337,082 to Fuisz et al.; U.S. Pat. No. 6,596,298 to Leung et al.; U.S. Pat. No. 7,067,115 to Bess et al.; and U.S. Pat. No. 7,025,983 to Leung et al.; US 2004/0241242 to Fuisz et al.; US 2005/0244521 to Strickland et al.; US 2006/0039953 to Leung et al.; US 2006/0198873 to Chan et al.; US 2006/0204559 to Bess et al.; US 2007/0069416 to Yang et al.; US 2008/0029110 to Dube et al.; U.S. Ser. No. 11/781,641 to Mua et al. (2007); and U.S. Ser. No. 12/014,525 to Robinson et al. (2008), all of which are incorporated by reference herein in their entirety.

The shape of the outer surface of the containers of the invention can vary. Although the container embodiments illustrated in the drawings have certain contours, containers with other exterior surface designs could also be used. For example, the sides or edges of the containers of the invention could be flattened, rounded, or beveled, and the various surfaces or edges of the container exterior could be concave or convex. Further, the opposing sides, ends, or edges of the container can be parallel or non-parallel such that the container becomes narrower in one or more dimensions.

The dimensions of the containers described herein can vary without departing from the invention. However, in preferred embodiments, the containers of the invention can be described as having a size suitable for handheld manipulation and operation. Exemplary dimensions for such handheld embodiments include lengths in the range of about 25 mm to about 200 mm, more typically about 50 mm to about 150 mm, and most often about 80 mm to about 120 mm. Exemplary widths include the range of about 10 mm to about 100 mm, more typically about 20 mm to about 80 mm, and most often about 30 mm to about 60 mm. As used herein, length and width refer to the major dimensions of the container that define the major plane of the container. Exemplary depths for handheld container embodiments of the invention range from about 5 mm to about 50 mm, more typically about 8 mm to about 30 mm, and most often about 10 mm to about 20 mm.

The number of solid product units stored in the containers of the invention can also vary, depending on the size of the container and the size of the product units. Typically, the number of stored product units will vary from about 5 to about 100, more typically about 10 to about 50, and most often about 15 to about 30.

The material of construction of the container can also vary. Exemplary materials include metal, wood, and synthetic plastic materials. Polymeric materials that can be extruded and/or molded into desired shapes are typically utilized, such as polyethylene, polystyrene, polyamide, and the like.

In certain embodiments, the containers of the invention combine several advantageous features, such as child-resistance, moisture protection, and metered dispensing of a product. In particular, certain embodiments of the containers of the invention include a child-resistant locking mechanism that releasably locks a dispensing chamber of the container in a closed and locked position. The locking mechanism can be released and a product dispensed using a series of manipulations including, for example, depressing a locking button or flap and separating portions of the container to expose the product to be dispensed. The containers of the invention can provide moisture protection of the product by providing a sealing member for limiting moisture content within the container. The containers of the invention also provide, in certain embodiments, metered dispensing of the product by providing a dispensing pathway sized for passage of a single unit of the product so that only a single unit of product can enter a dispensing aperture at one time.

Certain preferred embodiments of the invention are described herein as referring to metered dispensing of a single unit of product, which can be, for example, a single consumable unit of a smokeless tobacco product, a single consumable unit of a confectionary or snack product, or a single dosage unit of a pharmaceutical product. However, the invention encompasses embodiments where the product is dispensed in greater amounts, such as a plurality of units. For example, the dispensing aperture and dispensing chamber described herein could be sized to provide space for more than one unit of product if desired.

FIGS. 1-21 illustrate various container embodiments 10 in accordance with the present invention. The container 10 can include an outer casing body 100 having a cavity 102 defined thereby. In some instances, the outer casing body 100 may be formed of first and second portions 104, 106, which cooperate to form an enclosure so as to define the cavity 102. That is, the first and second portions 104, 106 can operate in a clamshell-like manner between a closed position (FIGS. 1A and 1B) and an open position (FIGS. 2A and 2B). In this regard, the outer casing body 100 may be a single piece having the first and second portions 104, 106 integrally formed.

In some embodiments, the outer casing body 100 may include a hinge portion 108 for hingedly coupling the first and second portions 104, 106 such that the outer casing body 100 can move between the closed and open positions. The hinge portion 108 may be integrally formed with the first and second portions 104, 106 such that the outer casing body is formed as a single unit. In other instances, the first and second portions 104, 106 may be discrete (separate) pieces that are hinged by a discrete hinge member (not shown). In another embodiment, the first and second portions 104, 106 may be discrete pieces that are not hinged, but still allow separation of the first and second portions 104, 106. That is, the first portion 104 may be entirely removable with respect to the second portion 106 so as to permit access to the cavity 102 defined thereby.

The outer casing body 100 may include a child resistance or locking mechanism, generally designated 500, to maintain the outer casing body 100 in a closed and locked position, as shown in FIGS. 1A and 1B. By releasing the locking mechanism 500, the first and second portions 104, 106 of the outer casing body 100 can be separated such that the contents stored within the outer casing body 100 may be accessed in an open and dispensing position. In the embodiments shown, the first and second portion 104, 106 are hingedly coupled such that the first portion 104 is rotated with respect to the second portion 106 after the locking mechanism is released. Various embodiments of the locking mechanism 500 are shown throughout the drawings and each will be discussed in detail further below.

The container 10 further includes a dispensing tray 200 for storing a product to be dispensed. The dispensing tray 200 may be received within the cavity 102 of the outer casing body 100. In one embodiment, the dispensing tray 200 may be received within the second portion 106 of the outer casing body 100. The dispensing tray 200 may be permanently or temporarily coupled to the second portion 106. For example, the dispensing tray 200 may be securely coupled to second portion 106 via an interference fit or with an adhesive fastener, or otherwise by any appropriate fastening or coupling mechanism. In other instances, the dispensing tray 200 may be integrally formed with the outer casing body 100 as a single piece unit. In such instances, the dispensing tray 200 and the outer casing body 100 may not be separate and distinct pieces. Both the dispensing tray 200 and the outer casing body 100 can be constructed in multiple parts that are affixed together using any means known to the skilled artisan. In other instances, both the dispensing tray 200 and the outer casing body 100 could be formed as a single unitary structure. One or more open-ended slots 112 may be defined by the outer casing body 100 to facilitate removal of the dispensing tray 200 therefrom.

The dispensing tray 200 may include an internal storage compartment 202 for storage of a plurality of units 300 (FIGS. 6, 10, and 15) of a product to be dispensed. A floor 204 of the dispensing tray 200 may define one or more indentations 206 that facilitate removal of a single unit 300 from the internal storage compartment 202. A peripheral portion 208 of the dispensing tray 200 extends about a perimeter or periphery of at least a portion of the dispensing tray 200. That is, the peripheral portion 208 may be defined by an outer surface of one or more side walls defining an outer portion of the dispensing tray 200. In some instances, the peripheral portion 208 may substantially conform to or otherwise mate with the shape of the outer casing body 100. However, the peripheral portion 208 may have any shape or size for fitting within the outer casing body 100.

A cover plate or portion 250 may be provided for containing the units 300 within the internal storage compartment 202. In some instances, the cover portion 250 may be provided as a separate and discrete piece from the dispensing tray 200. The dispensing tray 200 may define a ledge 210, which, in some instances, may be substantially planar, for receiving the cover portion 250 in a recessed manner such that the dispensing tray 200 and the cover portion 250 form a substantially planar upper surface 212. The cover portion 250 may be secured to the dispensing tray 200 plate by any suitable mechanism, including, but not limited to, a press-fit, snap-fit, or interference fit. However, other methods for affixing these cover portion 250 and the dispensing tray 200 may be provided. In some instances, the dispensing tray may include a channel 220 configured to receive a lip portion 254 of the cover portion 250 (see FIG. 16). According to some embodiments, the cover portion 250 may be integrally formed with the dispensing tray 200 such that the cover portion 250 and dispensing tray 200 are provided as a single piece.

In some instances, the cover portion 250 may be opaque (FIGS. 3A, 3B, 4, 7, 8 and 11-13), while in other instances the cover portion may 250 may be non-opaque (i.e., translucent or transparent; FIGS. 5, 6, 9, 10, 14 and 15) such that an amount of units 300 of product remaining in the internal storage compartment 202 can be determined. The cover portion 250 may define a dispensing aperture 214 through which the product can pass for removal from the dispensing tray 200. The dispensing aperture 214 may be of any shape or size and, in some instances, may be substantially the same shape and size as the product stored in the dispensing tray 200. The dispensing aperture 214 may be sized and configured to allow only a single unit of the stored product to pass through the dispensing aperture 214, although the dispensing aperture 214 could also be configured to allow a larger defined number of product units to pass at one time.

FIGS. 3A, 3B, 4 and 5 illustrate a container embodiment 10 that is particularly well-suited for storage and dispensing of a product having a pill or tablet shape. As shown in the exploded view of FIG. 4, the dispensing tray 200 has interior walls 216 that define the internal storage compartment 202 for storage of the products to be dispensed. The dispensing tray 200 may also have blocking walls 218 that define a dispensing pathway such that the product can be directed proximate to the dispensing aperture 214 for dispensing from the container 10. The internal storage compartment 202 faces the cover portion 250 to enclose the internal storage compartment 202. The cover portion 250 may also include one or more walls 252 for cooperating with the blocking walls 218 of the dispensing tray to define the dispensing pathway. The blocking walls 218 and/or walls 252 may be arranged in a manner such that the dispensing pathway is defined as a tortuous path which prevents the product from traversing a straight path to a dispensing zone proximate to the dispensing aperture 214. Further, the dispensing pathway may be dimensioned such that only a single unit of product can pass at a time between the blocking walls 218 and/or walls 252 defining the dispensing pathway. That is, in some instances, the units of product move along the dispensing pathway in serial alignment.

FIGS. 7-9 illustrate a container embodiment 10 that is particularly well-suited for storage and dispensing of a product having a strip or film shape. As shown in the exploded view of FIG. 8, the dispensing tray 200 has interior walls 216 that define the internal storage compartment 202 for storage of the products to be dispensed. As shown in FIGS. 9 and 10, the cover portion 250 may include a plurality of projections 256 extending substantially perpendicular from the cover portion 250 toward the internal storage compartment 202. The terminal end of each projection may be ramped or otherwise inclined so as to provide resistance or interference to the product for preventing sliding of the product out of the internal storage compartment 202. The internal storage compartment 202 faces the cover portion 250 to enclose the internal storage compartment 202.

FIGS. 11-14 illustrate a container embodiment 10 that is particularly well-suited for storage and dispensing of a product having a stick or rod shape. As shown in the exploded views of FIGS. 12 and 13, the dispensing tray 200 has interior walls 216 that define the internal storage compartment 202 for storage of the products to be dispensed. As shown in FIGS. 12 and 14, the cover portion 250 may include one or more lip portions 258 extending substantially perpendicular to the cover portion 250 toward the internal storage compartment 202. The lip portions 258 serve to maintain the product within the internal storage compartment 202 until dispensing thereof is initiated, while also facilitating metering of the product. In this particular embodiment, the dispensing tray 200 may also define a ramp member 230 configured to facilitate removal of the stick or rod shaped product from the container 10, as shown in FIGS. 11 and 13.

Embodiments of the present invention may also include a sealing member 400 for sealing the product within the container 10 and providing a moisture barrier to limit degradation of the product due to moisture or other environmental conditions. As shown in FIGS. 2A, 3A, 4, 5, 7-9, 11-14, 16, 17A, 17B, 18, 19B, 20B, 20C and 21, the sealing member 400 may be operably engaged with the outer casing body 100. In some instances, the sealing member 400 may be fixed, coupled, secured or otherwise fastened to the outer casing body 100. In other instances, the sealing member 400 may be integrally formed with the outer casing body 100 so as to form a unitary structure. According to one embodiment, the sealing member 400 may be provided on the first portion 104 of the outer casing body 100.

In some instances, the sealing member 400 may be substantially configured as a ridge or rib-like structure, as particularly shown in FIG. 16. In such instances, the sealing member 400 may contact and interact with the peripheral portion 208 of the dispensing tray 200 to provide a seal at least partially about the dispensing tray 200. In this regard, the sealing member 400 and the peripheral portion 208 interact in an interference manner to provide a moisture barrier seal. FIG. 16 illustrates various sizes of the ridge in which the sealing member 400 may be configured. For example, sealing member 400*a* represents a rib structure having a shallow profile, sealing member 400*b* represents a rib structure having an intermediate profile, and sealing member 400*c* represents a rib structure having a deep profile. A larger rib structure may provide more interference with the dispensing tray 200. As shown in FIG. 16, the sealing member 400 may extend from an interior wall 120 of the outer casing body 100 extending toward the interior thereof. In this particular embodiment, the sealing member 400*b* illustrates a profile increase of about 0.002 inches over the profile of sealing member 400*a*, while the sealing member 400*c* illustrates a profile increase of about 0.005 inches over the profile of sealing member 400*b*.

In other embodiments, the sealing member 400 may be provided about the peripheral portion 208 of the dispensing tray 200, as shown in FIG. 3B. That is, in some instances, the sealing member 400 may be fixed, coupled, secured or otherwise fastened to the dispensing tray 200 about the peripheral portion 208 thereof. In other instances, the sealing member 400 may be integrally formed with the dispensing tray 200 about the peripheral portion 208 thereof so as to form a unitary structure.

The outer casing body 100 shown in FIGS. 1A, 1B, 2A, 2B, 3A, 3B, 4, 5, 7-9, 11-14, 17A, 17B, 18, 19A, 19B, 20A, 20B, 20C and 21 also includes a child resistance or locking mechanism 500. In operation, the outer casing body 100 can be manipulated by a user to unlock the outer casing body 100 from its closed and locked position so that the portions of the outer casing body 100 can separate to the open and dispensing position, thereby providing access to the dispensing tray 200 and the product stored therein.

FIGS. 1A, 1B, 2A, 2B, 3A, 3B, 4, 5, 7-9, 11-14 illustrate one embodiment of the locking mechanism 500 capable of implementation in accordance with the container 10 of the present invention. The locking mechanism 500 may include a moveable flap 502 formed on the second portion 106 and configured to deflect or flex toward the interior of the container 10 so as to release the locking mechanism 500. A pair of projecting members 504 may be integrally formed on the second portion 106 of the outer casing body 100 and disposed adjacent the flap 502. The projecting member 504 may be configured to interact with a pair of tab portions 506 integrally formed on the first portion 104 of the outer casing body 100 and defining a pair of slots 508 for receiving a portion of the projecting members 504. That is, the slots 508 of the tab portions 506 may be positioned to engage the projecting members 504 when the outer casing body 100 is in the closed and locked position. The tab portions 506 may be configured to deflect or flex outward of the interior of the container 10 such that the tab portions 506 and the projecting members 504 interact to provide a press-fit or snap-fit. To release the locking mechanism 500, the flap 502 may be deflected toward the interior of the outer casing body 100, thereby also deflecting the projecting members 504 out of engagement with the slots 508 of the tab portions 506. As such, the first and second portions 104, 106 may be separated through rotation with respect to each other about the hinge portion 108.

FIGS. 17A and 17B illustrate another embodiment of the locking mechanism 500 capable of implementation in accordance with the container 10 of the present invention. The first portion 104 of the outer casing body 100 may include a pair of tabs 510 having projections 512 extending therefrom. The second portion 106 of the outer casing body 100 may define a pair of slots 514 for correspondingly receiving the tabs 510 and projections 512 when the outer casing body 100 is in the closed and locked position. In this manner, the tabs 510 and projections 512 provide a press-fit or snap-fit to maintain the outer casing body 100 in the locked and closed position. A grasp portion 516 may be provided on the first portion 104 of the outer casing body 100 to provide the user with a grasping portion for moving the outer casing body 100 between the locked and closed position and the dispensing position. A pair of recessed portions 518 may be provided along the peripheral portion 208 of the dispensing tray 200 to allow the tabs 510 to extend therethough into the slots 514.

FIG. 18 illustrates another embodiment of the locking mechanism 500 capable of implementation in accordance with the container 10 of the present invention. The locking mechanism 500 is similar to that illustrated by FIGS. 1A, 1B, 2A, 2B, 3A, 3B, 4, 5, 7-9, 11-14, wherein deflection of the moveable flap 502 causes disengagement of the tab portions 506 and the projecting members 504. In addition, the dispensing tray 200 may include a pair of arm members 520 configured to be correspondingly received within a pair of channels 522 defined by the second portion 106 of the outer casing body 100. The arm members 520 are biased outwardly of the peripheral portion 208 of the dispensing tray 200. In operation, the arm members 520 are deflected inwardly toward the peripheral portion 208 of the dispensing tray 200 such that the arm members 520 may be received within the channels 522 in an interference or snap-fit. In this regard, a pair of post members 520*a* may be aligned with the projecting members 504 so as to prevent the projecting members 504 from deflecting, thereby preventing the projecting members 504 from disengaging the slots 508 and the tab portions 506. The second portion 106 may define openings disposed proximate to arm member portions 520*b* of the arm members 520. In this regard, the arm member portions 520*b* may be seated adjacent the openings such that the arm member portions 520*b* can extend out of the second portion 106 so as to take the post members 520*a* out of alignment with the projecting members 504. As such, the deflecting members 504 can deflect inward toward the dispensing tray 200 for disengagement from the slots 508 and the tab portions 506.

FIGS. 19A and 19B illustrate another embodiment of the locking mechanism 500 capable of implementation in accordance with the container 10 of the present invention. The second portion 106 of the outer casing body 100 includes a resilient arcuate button 530, which can be depressed to release the locking mechanism 500. In this regard, the outer casing body 100 is locked and closed by an interference fit, wherein depressing the button 530 assists in releasing the interference fit such that the outer casing body 100 can be moved to the dispensing position. That is, depressing the button 530 permits access to a lower surface 532 of a lip portion 534 such that a user can apply an axial force to the lower surface 532 for separating the first and second portions 104, 106 to access the dispensing tray 200.

FIGS. 20A, 20B, and 20C illustrate another embodiment of the locking mechanism 500 capable of implementation in accordance with the container 10 of the present invention. Similar to the embodiment illustrated in FIGS. 1A, 1B, 2A, 2B, 3A, 3B, 4, 5, 7-9, 11-14, the second portion 106 includes the projecting members 504 that may be configured to interact with the slots 508 and the tab portions 506 integrally formed on the first portion 104 of the outer casing body 100 to maintain the container 10 in the locked and closed position. In addition, the dispensing tray 200 can include an arm member 540 configured to be received in a channel 542 defined by the second portion 106 of the outer casing body 100. The arm member 540 is normally biased outwardly of the peripheral portion 208 of the dispensing tray 200. The arm member 540 may be separately or integrally formed with the dispensing tray 200. The arm member 540 may include a tab member 544 and one or more extension portions 545.

The arm member 540 may be deflected inwardly toward the peripheral portion 208 of the dispensing tray 200 such that the arm member 540 may be received within the channel 542. The tab member 544 of the arm member 540 may extend through a slot 546 defined by the second portion 106 of the outer casing body 100. The tab member 544 is capable of sliding laterally within the slot 546 so as to release the locking mechanism 500 such that the container 10 can move between the locked and closed position and the dispensing position. That is, sliding the tab member 544 causes the arm member 540 to move laterally within the channel 542, thereby causing extension portions 545 to move into and out of an adjacent position with respect to the projecting members 504.

When adjacent to the projecting members 504, the extension portions 545 prevent the projecting members 504 from deflecting inwardly toward the dispensing tray 200, as shown in FIG. 20C. Therefore, when aligned with the projecting members 504, the extension portions 545 assist in preventing separation of the first and second portions 104, 106 such that the container 10 may be maintained in the locked and closed position. To move the container 10 to the dispensing or open position, the tab member 544 is moved laterally such that the extension portions 545 are not in alignment with the projecting members 504 such that the projecting members 504 can be deflected inwardly and out of engagement with the slots 508 and the tab portions 506. Additionally, the button 530 can be depressed, concurrent with the misalignment of the extension portions 545 and the projecting members 504, such that an axial force can be applied to the first portion 104 proximate to the button 530 so as to separate the first and second portions 104, 106 to access the dispensing tray 200.

FIG. 21 illustrates another embodiment of the locking mechanism 500 capable of implementation in accordance with the container 10 of the present invention. The locking mechanism 500 is similar to that illustrated by FIGS. 19A and 19B, wherein the outer casing body 100 is locked and closed by an interference fit, wherein depressing the resilient button 530 assists in releasing the interference fit such that the outer casing body 100 can be moved to the dispensing position. In this embodiment, the button 530 is substantially planar rather than arcuate, wherein the button 530 may be depressed to release the locking mechanism 500. That is, depressing the button 530 permits access to a lower edge 536 of a projection portion 538 of the first portion 104 such that a user can apply an axial force to the lower edge 536 for separating the first and second portions 104, 106 to access the dispensing tray 200. According to one embodiment, a lateral surface 537 of the button 530 (i.e., the portion engaged by a user) may be disposed substantially planar with respect to a front wall 539 of the second portion 106. In other instances, the lateral surface 537 of the button 530 may be recessed inwardly with respect to the front wall 539.

As part of the final packaging process, once the dispensing containers of the invention are filled with the desired product, the containers can be over-wrapped or over-sealed with a film material, or shrink-wrapped with such a material. The outer packaging material useful in accordance with the present invention can vary. Typically, the selection of the packaging material is dependent upon factors such as aesthetics, transparency, comfort of handling, desired barrier properties (e.g., so as to provide protection from exposure to oxygen or radiation, or so as to provide protection from loss of moisture), or the like. The packaging material preferably has the form of a film, such as a laminated film (e.g., a co-extruded laminated film). Representative materials that can be used to provide components or layers of film materials or laminated films include polyvinyl chloride, ethylene vinyl acetate co-polymer, oriented polypropylene, linear low density polyethylene, polyvinylidene dichloride, polyester terephthalate, ethylene methacrylic acid co-polymer, metallacene linear low density polyethylene, cellulosic materials (e.g., cellophane), and the like. Exemplary packaging materials can be plastic/metal films, plastic/metal films that are paper coated, plastic laminate films, or the like. US 2008/0029116 to Robinson et al. discloses examples of suitable packaging materials.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A dispensing container, comprising:

an outer casing body having a cavity therein, the outer casing body having first and second portions cooperatively configured such that the outer casing body is capable of moving between a closed and locked position and a dispensing position, wherein at least one of the first and second portions of the outer casing body include an interior wall facing the interior of the cavity;

a dispensing tray inserted within the cavity of the outer casing body and having an outer peripheral portion configured to conform to the shape of the interior wall of the outer casing body, the dispensing tray comprising an internal storage compartment adapted for storage of a plurality of units of a product to be dispensed;

a cover plate removably secured to the dispensing tray and defining at least one dispensing aperture through which a stored unit of product is accessible from the internal storage compartment of the dispensing tray when the outer casing body is in the dispensing position;

a sealing member operably engaged with one of the interior wall of the outer casing body and the dispensing tray, the sealing member comprising a rib structure configured to form a seal between the interior wall of the outer casing body and the outer peripheral portion of the dispensing tray when the outer casing body is in the closed and locked position, the interior wall of the outer casing body and the outer peripheral portion of the dispensing tray extending substantially parallel to one another with the rib structure extending substantially perpendicularly therebetween in the closed and locked position; and a locking mechanism operably engaged with the outer casing body and configured to releasably lock the outer casing body in the closed and locked position, wherein the locking mechanism is spaced apart from the outer peripheral portion of the dispensing tray.

2. The dispensing container of claim 1, wherein the locking mechanism comprises at least one protrusion projecting from the second portion of the outer casing body and positioned adjacent to a moveable flap formed in the second portion of the outer casing body, and at least one aperture defined by the first portion of the outer casing body and operatively positioned to engage the at least one protrusion when the outer casing body is in the closed and locked position, such that depressing the flap will effect separation of the at least one protrusion from the at least one aperture and allow separation of the first and second portions of the outer casing body.

3. The dispensing container of claim 1, wherein the dispensing tray is seated within the second portion of the outer casing body, and the first portion of the outer casing body comprises a substantially planar portion and said interior wall extending substantially perpendicular thereto and having an internal surface, the rib structure being integrally formed with and longitudinally extending about the interior wall to form the sealing member.

4. The dispensing container of claim 1, wherein the sealing member is configured to form an interference fit between the interior wall of the outer casing body and the outer peripheral portion of the dispensing tray when the outer casing body is in the closed and locked position.

5. The dispensing container of claim 1, wherein the dispensing tray is integrally formed with the outer casing body.

6. The dispensing container of claim 1, wherein the first and second portions of the outer casing body are hingedly coupled to facilitate movement between the closed and locked position and the dispensing position.

7. The dispensing container of claim 1, wherein the locking mechanism comprises a button that is depressed to release the dispensing container from the closed and locked position.

8. The dispensing container of claim 1, wherein the dispensing aperture is sized for passage of a single unit of the product.

9. The dispensing container of claim 1, wherein the internal storage compartment comprises a plurality of products.

10. The dispensing container of claim 1, wherein the product is characterized by a shape selected from the group consisting of pill, tablet, strip, orb, sphere, sheet, coin, cube, bead, ovoid, obloid, bean, stick, and rod.

11. The dispensing container of claim 1, wherein the product is selected from the group consisting of pharmaceutical products, smoking products, smokeless tobacco products, snack products, and confectionary products.

12. The dispensing container of claim 1, wherein the product is a smokeless tobacco product.

13. The dispensing container of claim 1, wherein the product is selected from the group consisting of pharmaceutical products, candies, mints, and gums.

14. The dispensing container of claim 1, wherein the dispensing tray includes at least one wall portion extending toward the cover plate and the cover plate comprises a wall portion that extends toward the dispensing tray, the wall portion of the dispensing tray and the wall portion of the cover plate cooperatively defining a non-linear dispensing pathway configured to direct the product to the dispensing aperture.

15. The dispensing container of claim 1, wherein the dispensing tray further comprises a floor configured to support the units of product thereon such that the dispensing tray substantially encapsulates the units of the product, the floor defining one or more indentations in axial alignment with the at least one dispensing aperture and configured to facilitate removal of one of the units of product.

16. A method of dispensing a product from a container, comprising:

providing a container in a closed and locked position, the container comprising:

an outer casing body having a cavity therein, the outer casing body having first and second portions cooperatively configured such that the outer casing body is capable of moving between a closed and locked position and a dispensing position, wherein at least one of the first and second portions of the outer casing body include an interior wall facing the interior of the cavity;

a dispensing tray inserted within the cavity of the outer casing body and having an outer peripheral portion configured to conform to the shape of the interior wall of the outer casing body, the dispensing tray comprising an internal storage compartment adapted for storage of a plurality of units of a product to be dispensed;

a cover plate removably secured to the dispensing tray and defining at least one dispensing aperture through which a stored unit of product is accessible from the internal storage compartment of the dispensing tray when the outer casing body is in the dispensing position;

a sealing member operably engaged with one of the interior wall of the outer casing body and the dispensing tray, the sealing member comprising a rib structure configured to form a seal between the interior wall of the outer casing body and the outer peripheral portion of the dispensing tray when the outer casing body is in the closed and locked position, the interior wall of the outer casing body and the outer peripheral portion of the dispensing tray extending substantially parallel to one another with the rib structure extending substantially perpendicularly therebetween in the closed and locked position; and a locking mechanism operably engaged with the outer casing body and configured to releasably lock the outer casing body in the closed and locked position, wherein the locking mechanism is spaced apart from the outer peripheral portion of the dispensing tray;

releasing the locking mechanism so as to effectuate separation of the first and second portions of the outer casing body to the dispensing position; and removing at least one unit of product from the internal storage compartment.

17. The method of claim 16, wherein releasing the locking mechanism further comprises depressing a moveable flap formed in the second portion of the outer casing body such that depressing the flap effects separation of at least one protrusion from at least one aperture to allow separation of the first and second portions of the outer casing body, the at least one protrusion projecting from the second portion of the outer casing body and positioned adjacent to the moveable flap formed in the second portion of the outer casing body, and the at least one aperture defined by the first portion of the outer casing body and operatively positioned to engage the at least one protrusion when the outer casing body is in the closed and locked position.

18. The method of claim 16, wherein the internal storage compartment comprises a plurality of products.

19. The method of claim 16, wherein the product is characterized by a shape selected from the group consisting of pill, tablet, strip, orb, sphere, sheet, coin, cube, bead, ovoid, obloid, bean, stick, and rod.

20. The method of claim 16, wherein the product is selected from the group consisting of pharmaceutical products, smoking products, smokeless tobacco products, snack products, and confectionary products.

21. The method of claim 16, wherein the product is a smokeless tobacco product.

22. The method of claim 16, wherein the product is selected from the group consisting of pharmaceutical products, candies, mints, and gums.

23. A method of sealing a product in a container, comprising:

providing a container in a dispensing position, the container comprising:

an outer casing body having a cavity therein, the outer casing body having first and second portions cooperatively configured such that the outer casing body is capable of moving between a closed and locked position and a dispensing position, wherein at least one of the first and second portions of the outer casing body include an interior wall facing the interior of the cavity;

a dispensing tray inserted within the cavity of the outer casing body and having an outer peripheral portion configured to conform to the shape of the interior wall of the outer casing body, the dispensing tray comprising an internal storage compartment adapted for storage of a plurality of units of a product to be dispensed;

a cover plate removably secured to the dispensing tray and defining at least one dispensing aperture through which a stored unit of product is accessible from the internal storage compartment of the storage tray when the outer casing body is in the dispensing position;

a sealing member operably engaged with one of the interior wall of the outer casing body and the dispensing tray, the sealing member comprising a rib structure configured to form a seal between the interior wall of the outer casing body and the outer peripheral portion of the dispensing tray when the outer casing body is in the closed and locked position, the interior wall of the outer casing body and the outer peripheral portion of the dispensing tray extending substantially parallel to one another with the rib structure extending substantially perpendicularly therebetween in the closed and locked position; and a locking mechanism operably engaged with the outer casing body and configured to releasably lock the outer casing body in the closed and locked position, wherein the locking mechanism is spaced apart from the outer peripheral portion of the dispensing tray; and engaging the locking mechanism such that the first and second portions of the outer casing body enclose the dispensing tray and the sealing member seals the outer casing body to the dispensing tray.

24. The method of claim 23, wherein the first portion of the outer casing body comprising a substantially planar portion and said interior wall extending substantially perpendicular thereto and having an internal surface, the rib structure being integrally formed with and longitudinally extending about the interior wall to form the sealing member, wherein said step of engaging the locking mechanism further comprises engaging the locking mechanism such that the rib structure sealably interacts with the outer peripheral portion of the dispensing tray when the outer casing body is in the closed and locked position, the dispensing tray being seated within the second portion of the outer casing body.

25. The method of claim 23, wherein the internal storage compartment comprises a plurality of products.

26. The method of claim 23, wherein the product is characterized by a shape selected from the group consisting of pill, tablet, strip, orb, sphere, sheet, coin, cube, bead, ovoid, obloid, bean, stick, and rod.

27. The method of claim 23, wherein the product is selected from the group consisting of pharmaceutical products, smoking products, smokeless tobacco products, snack products, and confectionary products.

28. The method of claim 23, wherein the product is a smokeless tobacco product.

29. The method of claim 23, wherein the product is selected from the group consisting of pharmaceutical products, candies, mints, and gums.

30. The method of claim 16, wherein the dispensing tray includes at least one wall portion extending toward the cover plate and the cover plate comprises a wall portion that extends toward the dispensing tray, the wall portion of the dispensing tray and the wall portion of the cover plate cooperatively defining a non-linear dispensing pathway configured to direct the product to the dispensing aperture.

31. The method of claim 23, wherein the dispensing tray includes at least one wall portion extending toward the cover plate and the cover plate comprises a wall portion that extends toward the dispensing tray, the wall portion of the dispensing tray and the wall portion of the cover plate cooperatively defining a non-linear dispensing pathway configured to direct the product to the dispensing aperture.

32. The method of claim 16, wherein the dispensing tray further comprises a floor configured to support the units of product thereon such that the dispensing tray substantially encapsulates the units of the product, the floor defining one or more indentations in axial alignment with the at least one dispensing aperture and configured to facilitate removal of one of the units of product.

33. The method of claim 23, wherein the dispensing tray further comprises a floor configured to support the units of product thereon such that the dispensing tray substantially encapsulates the units of the product, the floor defining one or more indentations in axial alignment with the at least one dispensing aperture and configured to facilitate removal of one of the units of product.

* * * * *